US006698210B2

(12) United States Patent
Ogura et al.

(10) Patent No.: US 6,698,210 B2
(45) Date of Patent: Mar. 2, 2004

(54) COLD INSULATING CHAMBER

(75) Inventors: Yoshiaki Ogura, Sakai (JP); Jin Sakamoto, Yao (JP); Atsuko Sakai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/258,473

(22) PCT Filed: Apr. 23, 2001

(86) PCT No.: PCT/JP01/03484

§ 371 (c)(1),
(2), (4) Date: Oct. 25, 2002

(87) PCT Pub. No.: WO01/84065

PCT Pub. Date: Nov. 8, 2001

(65) Prior Publication Data

US 2003/0101733 A1 Jun. 5, 2003

(30) Foreign Application Priority Data

Apr. 27, 2000 (JP) ..... 2000-126868
Apr. 27, 2000 (JP) ..... 2000-127539
May 22, 2000 (JP) ..... 2000-149683

(51) Int. Cl.[7] ..... F25B 9/00; F25D 11/00
(52) U.S. Cl. ..... 62/6; 62/457.9
(58) Field of Search ..... 62/6, 457.9

(56) References Cited

U.S. PATENT DOCUMENTS 4,969,333 A * 11/1990 Osawa et al. ..... 62/6
4,996,841 A * 3/1991 Meijer et al. ..... 60/525
5,142,872 A * 9/1992 Tipton ..... 62/616
5,403,609 A * 4/1995 Subotics et al. ..... 426/524
5,572,872 A * 11/1996 Hlavacek ..... 62/3.6
5,642,622 A * 7/1997 Berchowitz et al. ..... 62/6
5,664,421 A * 9/1997 Matsue et al. ..... 62/6
6,192,703 B1 * 2/2001 Salyer et al. ..... 62/457.7
6,205,792 B1 * 3/2001 Anderson ..... 62/6
6,266,963 B1 * 7/2001 Rudick ..... 62/6
6,272,867 B1 * 8/2001 Barrash et al. ..... 62/6

FOREIGN PATENT DOCUMENTS

| | | | |
|---|---|---|---|
| JP | 54-51056 | A | 4/1979 |
| JP | 62-55062 | U | 4/1987 |
| JP | 63-52060 | U | 4/1988 |
| JP | 2-60655 | A | 3/1990 |
| JP | 4-50376 | U | 4/1992 |
| JP | 4-356626 | A | 12/1992 |
| JP | 5-223382 | A | 8/1993 |
| JP | 6-82145 | A | 3/1994 |
| JP | 6-307752 | A | 11/1994 |
| JP | 7-180921 | A | 7/1995 |
| JP | 8-327203 | A | 12/1996 |
| JP | 9-96480 | A | 4/1997 |
| JP | 9-264623 | A | 10/1997 |
| JP | 09-280713 | A | 10/1997 |
| JP | 2-143074 | A | 6/1998 |
| JP | 10-1487411 | A | 6/1998 |
| JP | 11-63781 | A | 3/1999 |
| JP | 11-182954 | A | 7/1999 |
| JP | 2000-97546 | | 4/2000 |

* cited by examiner

*Primary Examiner*—William C. Doerrler
(74) *Attorney, Agent, or Firm*—Birch, Stewart, Kolasch & Birch, LLP

(57) ABSTRACT

A cooler box includes a box member that has a hermetically closable cooling chamber formed inside it and that insulates heat and a cooling device that cools the interior of the cooling chamber. The cooling device is a Stirling-cycle refrigerator. Here, using a Stirling-cycle refrigerator as the cooling device helps realize a cooler box that can be operated from an easily available low-capacity, inexpensive power supply and that can cool a to-be-cooled article to a low temperature comparable with that produced by a freezer.

3 Claims, 13 Drawing Sheets

COLD INSULATING CHAMBER

This application is the national phase under 35 U.S.C. §371 of PCT International Application No. PCT/JP01/03484 which has an International filing date of Oct. 23, 2001, which designated the United States of America.

TECHNICAL FIELD

The present invention relates to a cooler box for storing food or the like, and more particularly to a cooler box that cools its interior by the use of a Stirling-cycle refrigerator.

BACKGROUND ART

Conventionally, various types of cooler box exist that use an electronic refrigerating device. One common type is cooler boxes that cool their interior by exploiting the properties of a Peltier device, as disclosed in Japanese Patent Application Laid-Open No. H6-307752. FIG. 27 shows an example of this type of cooler box. This cooler box is provided with a box member 301 and a cooling device 302. The box member 301 has substantially the shape of a rectangular parallelepiped, has a cooling chamber 301*a* formed inside it for storing food, drink and the like, and insulates heat. The cooling device 302 cools the interior of the cooling chamber 301*a*.

The box member 301 is composed of a body member 303, which has the shape of a bottomed cylinder and has the cooling chamber 301*a* formed inside it, and a lid member 304, which is fitted on the top face of the body member 303 so as to open and close the cooling chamber 301*a*. The body member 303 has a body casing 305, an inner vessel 308, which is composed of an inner casing 306 and a cooling wall 307 made of a metal such as aluminum, and a heat insulator 309, which fills the space between the body casing 305 and the inner vessel 308. The interior of the lid member 304 is filled with a heat insulator 310.

The cooling device 302 has a Peltier device 311, a spacer 312, and a heat-rejecting fin 313, and is composed of a cooling unit 314, which is fixed to the inner vessel 308 with screws or the like, a cooling fan 315, and a side cover 316 for covering the cooling unit 314 and the cooling fan 315. Incidentally, this cooler box can be used also as a warmer box when the direction of the electric current supplied to the Peltier device 311 is reversed so that the interior is heated.

The conventional cooler box described above typically consumes around 48 W of electric power. Thus, when mounted on a car, the cooler box can be operated from the car's battery without any problem. However, quite inconveniently, when used outdoors, the cooler box requires a high-capacity portable power supply for outdoor use. For example, when operated from a 12 V power supply, the cooler box, which consumes around 48 W of electric power, requires a current of 4 A. Accordingly, to use the cooler box for 10 hours or more, it is necessary to use a portable power supply with a capacity of 40 Ah or higher.

It is difficult, however, for a general user to obtain a portable power supply with such a high capacity, and, even if one is available, it is extremely expensive. Therefore, the user has no choice but to depend on electric power commercially distributed to a household or on a battery of a car. It is to be noted that the units used above are as follows: W stands for watts, V stands for volts, A stands for amperes, and h stands for hours.

In the conventional cooler box described above, a Peltier device is used as the cooling device. However, the lowest temperature produced by a Peltier device is about 0° C., and therefore it does not offer cooling performance comparable with that of a freezer (with an interior temperature of about −18° C.). Moreover, in the conventional cooler box, the volume of the cooling chamber cannot be varied. This often leads to inefficient cooling, with the cooling performance of the cooler box used wastefully to cool an article that can be cooled with lower cooling performance. Furthermore, in the cooler box described above, the Peltier device cools part of the wall surface of the box member. Thus, the interior temperature tends to vary from place to place.

DISCLOSURE OF THE INVENTION

An object of the present invention is to provide a cooler box that can be operated from a low-capacity, inexpensive power supply easily available to the user but that nevertheless offers cooling performance comparable with that of a freezer. Another object of the present invention is to provide a cooler box of which the cooling performance is variable according to what is to be cooled in it. Another object of the present invention is to provide a cooler box with more uniform interior temperature.

An object of the present invention is to provide a cooler box that can remove frost covering a cooling element so that stable cooling performance is obtained continuously from a cooling device.

An object of the present invention is to provide an energy-saving cooler box that can cool food, drink, and the like placed inside it or keep them cool while maintaining their freshness by storing cold produced by a cooling device.

To achieve the above objects, according to the present invention, a cooler box including a box member that has a hermetically closable cooling chamber formed therein and that insulates heat and a cooling device that cools the interior of the cooling chamber is characterized in that the cooling device is a Stirling-cycle refrigerator. With this construction, since the cooling device is a Stirling-cycle refrigerator, it is possible to realize a cooler box that can be operated from an easily available low-capacity, inexpensive power supply and that can cool a to-be-cooled article to a low temperature comparable with that produced by a freezer.

Here, the box member may be composed of a body member that has the cooling chamber formed therein and a lid member that is detachably fitted to the body member so as to open and close the cooling chamber, with the cooling device fitted to the lid member. This makes it possible to detach the lid member and wash it in its entirety, ensuring easy cleaning.

The box member may be composed of a floor wall and side walls that extend upward from the edges of the floor wall, with the cooling device fitted to the floor wall. This helps reduce the thickness of the side walls and thus the floor area occupied by the cooler box.

The cooling device may be fitted to the box member with its low-temperature head located below the high-temperature head. This prevents the air heated by the high-temperature head from making contact with the low-temperature head, and thus helps minimize the loss of cooling efficiency.

As the cooling device, a plurality of cooling devices may be provided that can be driven independently of one another. This makes it possible to cope with various set temperatures and various cooling patterns, and to obtain more uniform temperature.

The box member may have one or two pair of opposite side walls, with the cooling device fitted to each of the opposite side walls constituting each pair. This makes it possible to obtain more uniform temperature.

The cooling device may be detachable. This makes it possible to attach a cooling device most suitable to cool a given article and thereby achieve efficient cooling.

There may be additionally provided a liquid nitrogen container for instantaneously freezing a to-be-cooled article placed inside the cooling chamber. This makes it possible to cope with an article that needs to be cooled or frozen instantaneously.

The volume of the cooling chamber may be variable. This makes it possible to adjust the volume of the cooling chamber according to a to-be-cooled article so as to achieve efficient cooling.

There may be additionally provided a cooling element disposed at the low-temperature head of the cooling device and air circulating means for circulating the air inside the cooling chamber so as to bring the air into contact with the cooling element. This makes it possible to cool the air inside the cooling chamber by the cooling element and circulate the cooled air inside the cooling chamber so as to obtain more uniform temperature.

The cooling element may have a heat pipe. This makes it possible to conduct the low temperature produced by the Stirling-cycle refrigerator efficiently to the cooling element, and thus to cool the air inside the cooling chamber efficiently.

The Stirling-cycle refrigerator may be of a free-piston type that has a displacer reciprocating inside a cylinder filled with a working gas. This contributes to miniaturization and weight reduction.

According to another aspect of the present invention, a cooler box that includes a heat insulating box member having the interior thereof divided into a machine chamber and a cooling chamber and that cools food or drink placed inside the cooling chamber by introducing cold, produced by driving a Stirling-cycle refrigerator disposed inside the machine chamber, into the cooling chamber through a cooling element is characterized by the provision of frost removing means for removing frost covering the cooling element.

Here, the frost removing means may be heat generating means provided separately from the Stirling-cycle refrigerator. This makes it possible to energize the heating means as required to defrost the cooling element quickly.

The frost removing means may be waste heat conducting means for conducting the heat rejected from the heat rejecting portion of the Stirling-cycle refrigerator to the cooling element. This makes it possible to defrost the cooling element by exploiting the waste heat rejected from the heat rejecting portion.

The waste heat conducting means may be composed of: a first conduit for circulating a fluid between the heat rejecting portion of the Stirling-cycle refrigerator and a heat exchanger disposed away from the heat rejecting portion; a second conduit for circulating the fluid between the heat absorbing portion of the Stirling-cycle refrigerator and the cooling element disposed away from the heat absorbing portion; and flow path switching means located at where the first and second conduits cross each other to permit the first and second conduits to communicate with each other so as to form a single closed circuit.

The machine chamber may have the interior thereof divided by a partition wall into a cooling side where the cooling element is disposed and a heat rejecting side where the heat rejecting portion of the Stirling-cycle refrigerator is disposed, with the frost removing means composed of: a first valve for opening and closing an opening through which the cooling side of the machine chamber and the cooling chamber communicate with each other; and a second valve for opening and closing one of an opening formed in part of the partition wall or an opening formed between the heat rejecting side of the machine chamber and an exterior space. In this construction, when the first valve is closed and the second valve is so turned as to open the opening formed in the partition wall, the heat in the heat rejecting side of the machine chamber is conducted to the cooling side, achieving the defrosting of the cooling element.

The frost removing means may be phase difference controlling means for raising the temperature of the heating element by operating, with completely or substantially no phase difference, a piston and a displacer disposed inside a cylinder of the Stirling-cycle refrigerator so as to reciprocate along the axis of the cylinder. When so operated, the Stirling-cycle refrigerator does not constitute the normal reverse Stirling cycle, but only generates heat in the expansion space. This heat is conducted through the heat absorbing portion to the cooling element so as to remove the frost covering the cooling element.

The Stirling-cycle refrigerator may be of a free-piston type that has a displacer reciprocating inside a cylinder filled with a working gas. This contributes to miniaturization and weight reduction.

According to another aspect of the present invention, a cooler box that includes a heat insulating box member having the interior thereof divided into a machine chamber and a cooling chamber and that cools food or drink placed inside the cooling chamber by introducing cold, produced by driving a Stirling-cycle refrigerator disposed inside the machine chamber, into the cooling chamber is characterized by the provision of cold storing means for storing the cold disposed inside the cooling chamber. This permits part of the cold introduced into the cooling chamber to be stored in the cold storing means disposed in the cooling chamber.

Here, the cold storing means may be a sheet-shaped cold storing member laid along part or all of the bottom and side surfaces of the cooling chamber.

The cold storing member may be laid also on the undersurface of a door that opens and closes an opening formed in the top face of the heat insulating box member.

The cold storing means may be a granular cold storing material disposed near the opening through which the cold is introduced into the cooling chamber.

The cold storing member may be made of a metal having high thermal conductivity.

The cold storing member may be composed of a material having a cold storing capability sandwiched between plates of a metal having high thermal conductivity. This helps enhance the cooling performance per unit area of the cold storing member.

The cold storing member may be detachable. This makes it possible to detach the cold storing member as required when the cooling chamber is cleaned.

The cold storing means may be a cold circulation path formed along the side surfaces of the cooling chamber. This permits part of the cold introduced into the cooling chamber to circulate through the circulation path and thereby store the cold.

The Stirling-cycle refrigerator may be of a free-piston type that has a displacer reciprocating inside a cylinder filled with a working gas. This contributes to miniaturization and weight reduction.

According to another aspect of the present invention, a cooler box that includes a heat insulating box member having the interior thereof divided into a machine chamber and a cooling chamber and that cools food or drink placed inside the cooling chamber by introducing cold, produced by driving a Stirling-cycle refrigerator disposed inside the machine chamber, into the cooling chamber is characterized by the provision of cold storing means for storing the cold disposed inside the machine chamber. This permits part of the cold obtained by driving the Stirling-cycle refrigerator to be stored in the cold storing means disposed in the machine chamber.

Here, the cold storing means may be a cylindrical cold storing member disposed inside the low-temperature portion, including the expansion space, of the Stirling-cycle refrigerator.

The cold storing means may be a sheet-shaped cold storing member laid so as to enclose the Stirling-cycle refrigerator.

The cold storing member may be made of a metal having high thermal conductivity.

There may be additionally provided a cooling fan for agitating the air inside the cooling chamber. This helps obtain uniform temperature distribution inside the cooling chamber.

There may be additionally provided an indicating means for indicating that the cold is being stored by the cold storing means. This permits the user to easily recognize whether the cold is being stored or not.

There may be additionally provided a switching means for choosing whether to use the cold storing means or not. This permits the user to freely turn on and off the cold storage mode.

The temperature at which to keep the interior of the cooling chamber may be adjustable according to use. This permits the user to freely change the temperature at which to keep an article place inside the cooling chamber according to the type or the like of the article.

The Stirling-cycle refrigerator may be of a free-piston type that has a displacer reciprocating inside a cylinder filled with a working gas. This contributes to miniaturization and weight reduction.

BEST MODE FOR CARRYING OUT THE INVENTION

Figure 1:
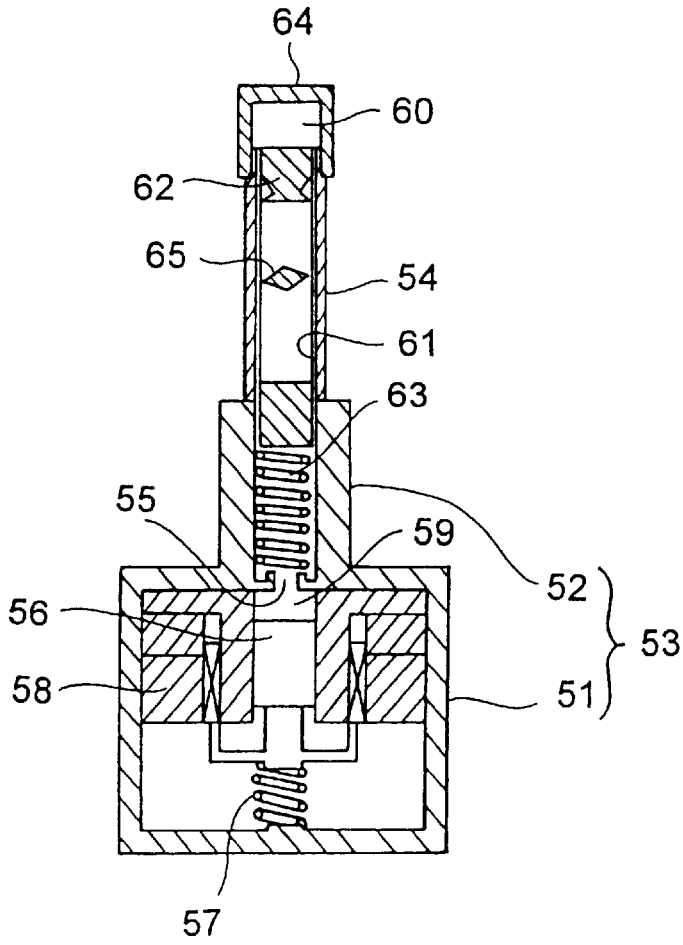
FIG. 1 is a vertical sectional view of the Stirling-cycle refrigerator used in the embodiments of the invention.
Figure 2:
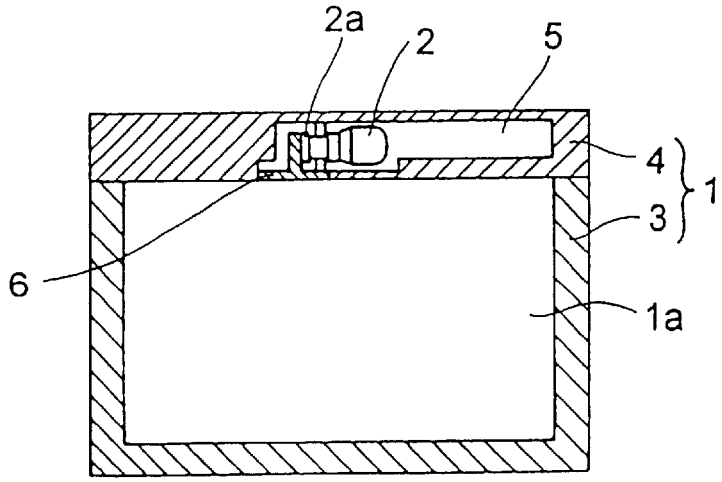
FIG. 2 is a vertical sectional view of a first embodiment of the invention.

Hereinafter, embodiments of the present invention will be described with reference to the drawings. FIG. 1 is a sectional view of the Stirling-cycle refrigerator used in the embodiments of the invention, and FIG. 2 is a vertical sectional view of a first embodiment of the invention. As shown in FIG. 2, a cooler box embodying the invention is provided basically with a box member 1 that has a hermetically closable cooling chamber 1*a* formed inside it and that insulates heat and a cooling device 2 that cools the interior of the cooling chamber 1*a*. Here, the cooling device 2 is a Stirling-cycle refrigerator.

A Stirling-cycle refrigerator adopts as a working medium a gas that has no adverse effects on the global environment, such as helium gas, hydrogen gas, or nitrogen gas, and produces cold by the reverse Stirling cycle. Stirling-cycle refrigerators are known as compact refrigerators that produce cryogenic temperatures.

This type of refrigerator is composed basically by combining together a compressor for compressing a cooling medium gas and an expander for expanding the cooling medium gas spewed out of the compressor. Used as the compressor here is a compressor that compresses the cooling medium gas in such a way that its pressure varies regularly with a predetermined period so as to describe, for example, a sine curve.

The refrigerator shown in FIG. 1 has a casing 53 composed of a casing body 51 formed in the shape of a bottomed cylinder and a cylindrical heat rejecting portion 52 formed so as to protrude upward from the top surface of the casing body 51. The top end of the heat rejecting portion 52 is connected to a vertically extending cylinder 54 so as to communicate with it, and the top end of the cylinder 54 is closed. The casing body 51 and the heat rejecting portion 52 communicate with each other through an opening 55.

The compressor is composed of a piston 56 guided inside the casing body 51 so as to freely reciprocate up and down, a spring 57 elastically supporting the piston 56 so as to permit it to freely reciprocate, and a linear motor 58 for driving the piston 56. The piston 56 driven by the linear motor 58 moves so as to describe a sine curve under the force exerted by the spring 57, and thus the pressure of the working gas inside the expansion space 59 formed between the tip end of the piston 56 and the opening 55 varies so as to describe a sine curve.

On the other hand, the expander is composed of a displacer 62 that is fitted inside the cylinder 54 so as to freely reciprocate and that divides the interior of the cylinder 54 into a expansion space 60 located at the tip end and a working space 61 located at the base end, and a spring 63 elastically supporting the displacer 62 to permit it to freely reciprocate.

The working space 61 is connected to the compressor, and, when the pressure of the cooling medium gas fed from the compressor into the expansion space 60 causes the displacer 62 to move toward the compressor, the cooling medium gas expands, with the result that cryogenic temperature is produced in a heat absorbing portion 64 at the tip end of the cylinder 54. A regenerator 65 is provided to achieve pre-cooling or pre-heating between the heat rejecting portion and the heat absorbing portion. This type of Stirling-cycle refrigerator is generally called a free-piston-type Stirling-cycle refrigerator.

As described above, in a cooler box embodying the invention, a Stirling-cycle refrigerator is used as a cooling device 2. This helps realize a cooler box that can be operated from an easily available low-capacity, inexpensive power supply and that can cool a to-be-cooled article to a low temperature comparable with that produced by a freezer. That is, a cooler box employing a Stirling-cycle refrigerator as a source of cold is superior to one employing a Peltier device in that the former generates cold at a cryogenic temperature below 0° C. This makes a cooler box embodying the invention particularly suitable for making ice and for freezing drink or food for storage.

The cooler box of the first embodiment has a box member 1 formed in the shape of a rectangular parallelepiped. The box member 1 is composed of a body member 3, which has the shape of a bottomed cylinder and has the cooling chamber 1*a* formed inside it, and a lid member 4, which is pivotably fitted on the top face of the body member 3 with a hinge mechanism (not shown) so as to open and close the cooling chamber 1*a*. The cooling device 2 is housed inside a space 5 formed in the lid member 4. The cold generated in a low-temperature head portion 2*a*, i.e., the heat absorbing portion, of the cooling device 2 is conducted through a cooling element 6 to the cooling chamber 1*a* inside the body member 3 so as to cool the interior of the cooling chamber 1*a*. The lid member 4 may be so fitted as to be removable from the body member 3 at the hinge mechanism (not shown). In that case, the lid member 4 can be detached from the body member 3, and thus, quite conveniently, the body member 3 can be washed in its entirety.

Figure 3:
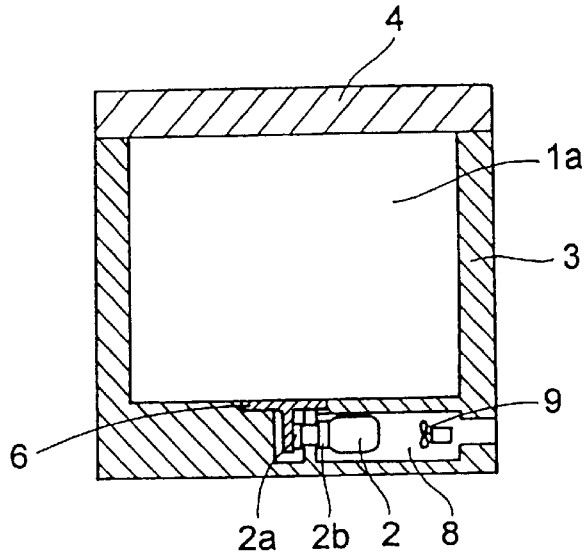
FIG. 3 is a vertical sectional view of a second embodiment of the invention.

Next, a second embodiment of the invention will be described with reference to FIG. 3. It is to be noted that, in the following descriptions of the individual embodiments, such components as find their counterparts in the first embodiment are identified with the same reference numerals, and overlapping explanations will be omitted. In this embodiment, the cooling device 2 is housed inside a space 8 formed in the bottom wall of the body member 3. The cold generated in the low-temperature head portion 2*a* of the cooling device 2 is conducted through the cooling element 6 to the cooling chamber 1*a* inside the body member 3, and the heat generated in a high-temperature head portion 2*b*, i.e., the heat rejecting portion, of the cooling device 2 is rejected through a cooling fan 9 out of the body member 3. In this embodiment, the cooling device 2 is housed in the bottom wall of the body member 3. This helps reduce the thickness of the side walls of the body member 3, and thus helps reduce the floor area occupied.

Figure 4:
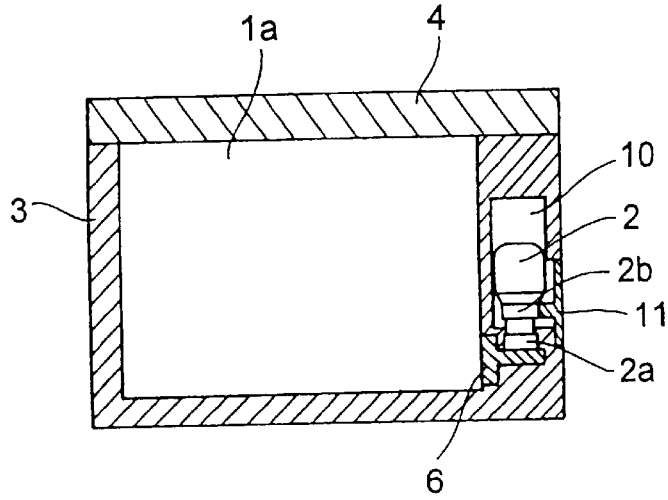
FIG. 4 is a vertical sectional view of a third embodiment of the invention.

Next, a third embodiment of the invention will be described with reference to FIG. 4. In this embodiment, the cooling device 2 is housed inside a space 10 formed in a side wall of the body member 3, with the low-temperature head portion 2*a* located below the high-temperature head portion 2*b*. The cold generated in the low-temperature head portion 2*a* is conducted through the cooling element 6 to the cooling chamber 1*a* inside the body member 3, and the heat generated in the high-temperature head portion 2*b* is conducted through a heat exchanger 11 out of the body member 3. The air heated by the high-temperature head portion 2*b* flows up. In this embodiment, the heated air is kept from making contact with the low-temperature head portion 2*a*. This helps reduce the loss of cooling efficiency.

Figure 5:
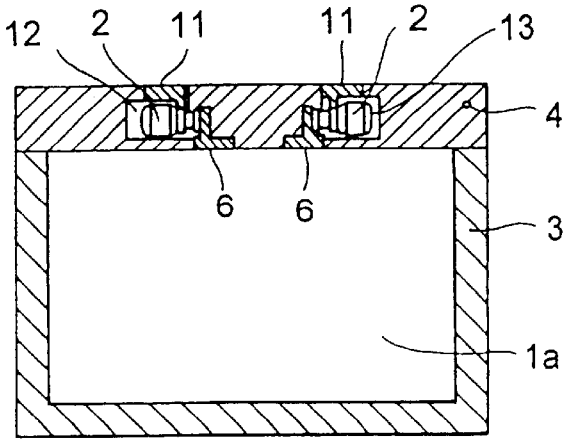
FIG. 5 is a vertical sectional view of a fourth embodiment of the invention.

Next, a fourth embodiment of the invention will be described with reference to FIG. 5. In this embodiment, two of the cooling device 2 are housed individually inside two spaces 12 and 13 formed in the lid member 4. The two cooling devices 2 can be driven independently of each other. In this embodiment, the two cooling devices 2 can be operated in different combinations of operation patterns. This makes it possible to keep the temperature inside the cooling chamber 1*a* inside the body member 3 in a temperature range most suitable for whatever is placed inside it.

The above description of this embodiment deals with a case where two cooling devices are provided. However, it is also possible to provide three or more cooling devices, in which case it is possible to adjust the temperature more finely. Using a plurality of cooling devices having different cooling performance, as compared with using ones having identical cooling performance, provides more varied operation patterns, and thus permits more finely controlled operation.

Figure 6:
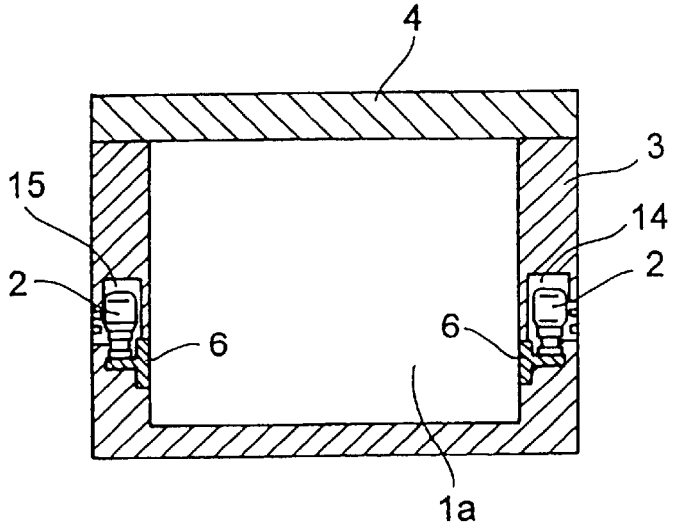
FIG. 6 is a vertical sectional view of a fifth embodiment of the invention.

Next, a fifth embodiment of the invention will be described with reference to FIG. 6. In this embodiment, two of the cooling device 2 are housed individually inside spaces 14 and 15 formed in a pair of opposite side walls of the body member 3. By cooling the interior of the cooling chamber 1*a* inside the body member 3 from two side surfaces in this way, it is possible to obtain more uniform temperature inside the cooling chamber 1*a*.

Figure 7:
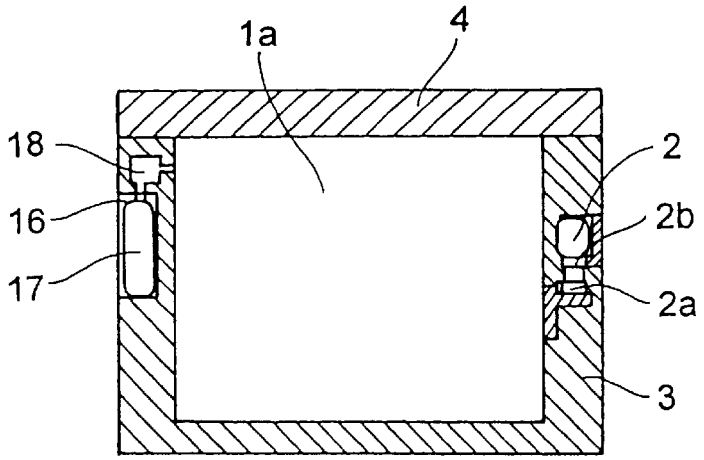
FIG. 7 is a vertical sectional view of a sixth embodiment of the invention.

Next, a sixth embodiment of the invention will be described with reference to FIG. 7. In this embodiment, the cooling device 2 is housed in one side wall of the body member 3, and, inside a space 16 formed in the side wall of the body member 3 opposite to the cooling device 2, a liquid nitrogen container 17 is detachably housed. The cold generated by the liquid nitrogen kept in the liquid nitrogen container 17 can be injected through a cold discharge adjuster 18 into the cooling chamber 1*a*. When an article needs to be cooled quickly, the cold at a cryogenic temperature generated by the liquid nitrogen is sprayed onto the article.

Figure 8:
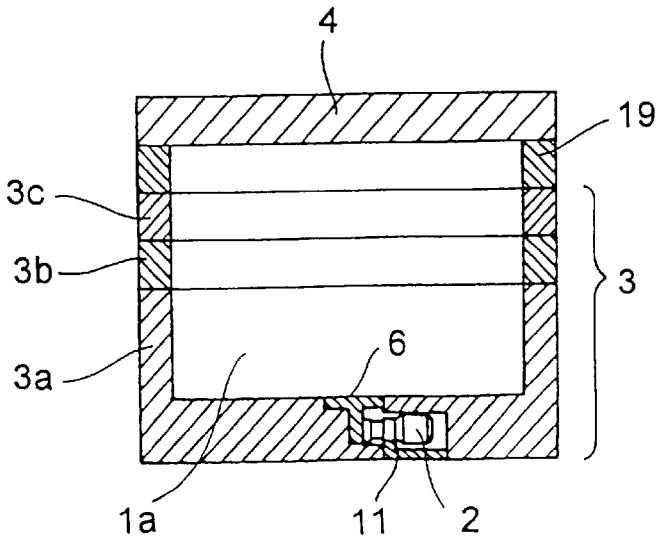
FIG. 8 is a vertical sectional view of a seventh embodiment of the invention.

Next, a seventh embodiment of the invention will be described with reference to FIG. 8. In this embodiment, the body member 3 is composed of a bottom portion 3*a* having the shape of a bottomed cylinder and two ring-shaped frame members 3*b* and 3*c* that are fitted to the bottom portion 3*a* by being piled on top of it. The frame members 3*b* and 3*c* are removable, and thus, by piling or removing them as required, it is possible to vary the volume of the cooling chamber 1*a*. The lid member 4 is supported on a frame member 19, to which the lid member 4 is pivotably fitted with a hinge mechanism (not shown). In this embodiment, by varying the volume of the cooling chamber 1*a* according to the size of an article to be cooled, it is possible to achieve efficient cooling.

Figure 9:
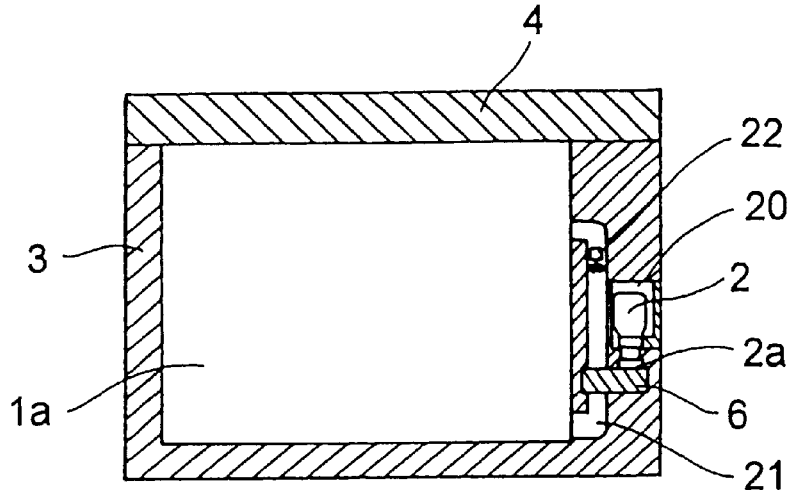
FIG. 9 is a vertical sectional view of an eighth embodiment of the invention.

Next, an eighth embodiment of the invention will be described with reference to FIG. 9. In this embodiment, the cooling device 2 is housed inside a space 20 formed in a side wall of the body member 3. The cold generated by the cooling device 2 conducts through the cooling element 6 to the air inside a duct 21 formed in the side wall of the body member 3, and this air is discharged into the cooling chamber 1*a* out of the duct 21 through one end thereof by a cooling fan (air circulating means) 22 provided inside the duct 21. The cold discharged into the cooling chamber 1*a* drives the air inside the cooling chamber 1*a* to flow into the duct 21 through the other end thereof, and this air is cooled by the cooling element 6. That is, the air inside the cooling chamber 1*a* is circulated by the cooling fan 22. This helps obtain more uniform temperature inside the cooling chamber 1*a*.

Moreover, in this embodiment, the cooling element 6 has a heat pipe (not shown) to permit the cold in the low-temperature head portion 2*a* of the cooling device 2 to be conducted efficiently to the entire cooling element 6. This ensures efficient heat exchange with air.

In any of the embodiments described thus far, the cooling device 2 may be detachably fitted to the box member 1. This make it possible to attach a cooling device most suitable for the temperature range required to cool a given article and thereby achieve efficient cooling.

Incidentally, in a cooler box employing a Stirling-cycle refrigerator, a cooling element for heat exchange is fitted to the low-temperature head portion so that the cold obtained in the low-temperature head portion is discharged through the cooling element into the interior of the cooler box by a fan or the like. Here, the cooling element becomes extremely cold, and therefore moisture condenses on its surface and fins, forming frost. This frost not only degrades the refrigerating performance of the Stirling-cycle refrigerator but also invites copious frost to collect between the fins of the cooling element. This prevents smooth discharge of the cold into the interior of the cooler box, and may thus have adverse effects on the drink and food placed inside the cooler box.

To cope with this, hereinafter, constructions of a cooler box will be described that permit removal of frost covering the cooling element and thereby enable a Stirling-cycle refrigerator to offer stable cooling performance continuously.

Figure 10:
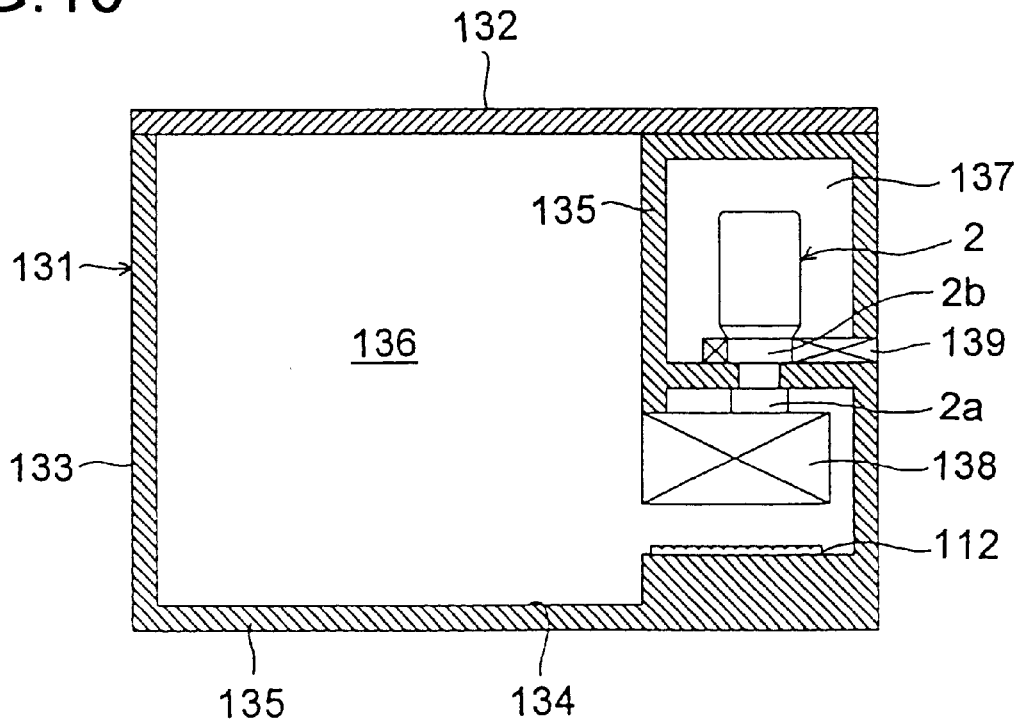
FIG. 10 is a schematic side sectional view of the cooler box of a ninth embodiment of the invention.

Now, a ninth embodiment of the invention will be described with reference to the drawings. FIG. 10 is a side sectional view of the cooler box of this embodiment. This cooler box is composed of a body member 131 formed in the shape of a box and a lid member 132 for opening and closing the opening formed in the top face of the body member 131. The body member 131 is composed of an outer box 133 and an inner box 134, and the gap between them is filled with a heat insulator 135. The heat insulator 135 also divides the space inside the inner box 134 into a cooling chamber 136 and a machine chamber 137. Inside the machine chamber 137 enclosed by the heat insulator 135 from all around, a cooling device 2 is housed.

A cooling element 138 is disposed so as to be kept in contact with the low-temperature head portion 2*a* of the cooling device 2. To collect the cold generated in the low-temperature head portion 2*a* and conduct it efficiently to the interior of the cooling chamber 136, the cooling element 138 has part thereof exposed on the cooling chamber 136, and has a large number of fins formed inside it. On the other hand, the heat radiated from the high-temperature head portion 2*b* is rejected to the exterior space through a heat exchanger 139, which is disposed so as to be kept in contact with the high-temperature head portion 2*b* and which has part thereof exposed on the exterior space.

Here, as described above, the cooling element 138 is kept in contact with the low-temperature head portion 2*a,* of which the temperature can fall to a cryogenic temperature below the freezing point. Thus, the cooling element 138 is cooled by the cold generated there to an extremely low temperature. Accordingly, while the cooler box is used continuously for a long period, moisture inside the machine chamber 137 condenses on the cooling element 138 and frost forms on it. When copious frost collects on the fins of the cooling element 138, it prevents smooth discharge of the cold into the cooling chamber 136 by a blowing means (not shown), and thus degrades cooling performance.

To avoid this, in this embodiment, a temperature sensor (not shown) for detecting the surface temperature of the cooling element 138 is provided, and, when the result of detection by the temperature sensor indicates that the cooling element 138 needs to be defrosted, the operation of the cooler box is switched to a defrosting mode. Specifically, in the defrosting mode, a heater 112 disposed near but separately from the cooling element 138 inside the machine chamber 137 is energized, and the cooling element 138 is defrosted by the heat so generated. This makes it possible to quickly remove frost on the cooling element 138 to allow the cooling device 2 to offer stable refrigerating performance continuously. The defrosting of the cooling element 138 may be performed periodically at predetermined time intervals by the use of a timer.

Figure 11:
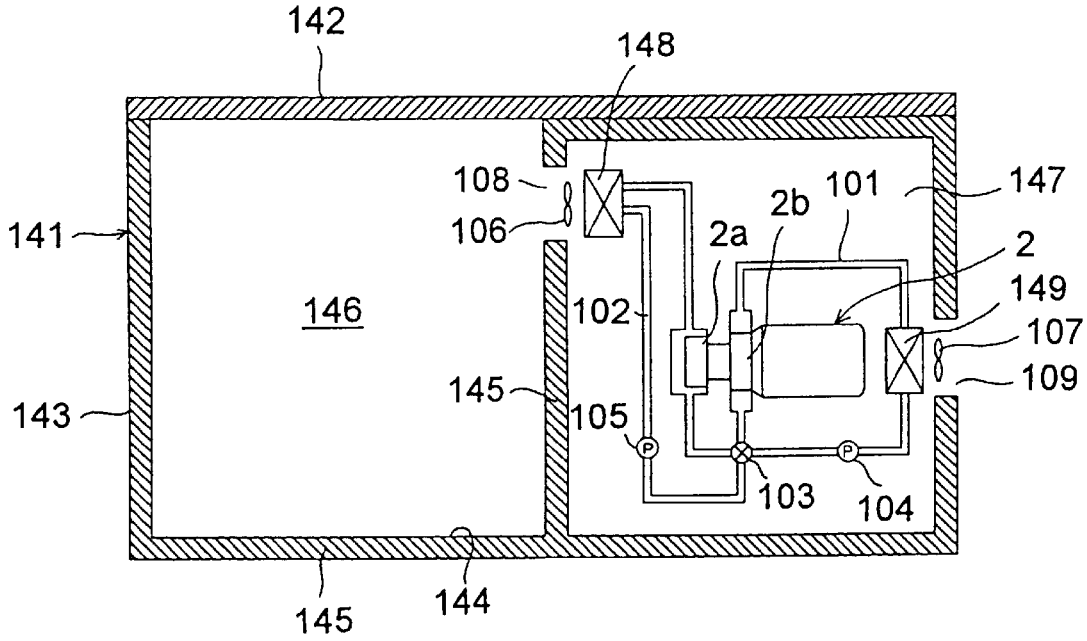
FIG. 11 is a schematic side sectional view of the cooler box of a tenth embodiment of the invention.

Next, a tenth embodiment of the invention will be described with reference to the drawings. FIG. 11 is a side sectional view of the cooler box of this embodiment. This cooler box is composed of a body member 141 formed in the shape of a box and a lid member 142 for opening and closing the opening formed in the top face of the body member 141. The body member 141 is composed of an outer box 143 and an inner box 144, and the gap between them is filled with a heat insulator 145. The heat insulator 145 also divides the space inside the inner box 144 into a cooling chamber 146 and a machine chamber 147. Inside the machine chamber 147 enclosed by the heat insulator 145 from all around, a cooling device 2 is housed.

Inside the machine chamber 147 formed inside the body member 141, there are arranged a first conduit 101 for circulating a fluid between the high-temperature head portion 2*b* of the cooling device 2 and a heat exchanger 149 disposed away from the high-temperature head portion 2*b*, a second conduit 102 for circulating the fluid between the low-temperature head portion 2*a* of the cooling device 2 and a cooling element 148 disposed away from the low-temperature head portion 2*a*, and a switching valve 103 located at where the first and second conduits 101 and 102 cross each other to permit the first and second conduits 101 and 102 to communicate with each other so as to form a single closed circuit.

The fluid is circulated through the first and second conduits 101 and 102 by pumps 104 and 105, respectively. It is advisable to use as the fluid a liquid that does not easily evaporate or freeze under normal conditions under which the cooler box is used. A first fan 106 blows the cold transferred to the cooling element 148 into the cooling chamber 146 through an opening 108 formed in the partition wall separating the cooling chamber 146 and the machine chamber 147. A second fan 107 rejects the heat transferred to the heat exchanger 149 to the external space through an opening 109 formed so as to penetrate the outer box 143 and the inner box 144 from inside the machine chamber 147.

In this embodiment also, as in the ninth embodiment described above, a temperature sensor (not shown) for detecting the surface temperature of the cooling element 148 is provided, and, when the result of detection by the temperature sensor indicates that the cooling element 148 needs to be defrosted, the operation of the cooler box is switched to a defrosting mode. Specifically, in the defrosting mode, the switching valve 103 is so switched that, at where the first and second conduits 101 and 102 cross each other, the first and second conduits 101 and 102 communicate with each other so as to form a single closed circuit. In this state, the high-temperature-side fluid that has thus far been circulated through the first conduit 101 is transferred through the closed circuit to the cooling element 148 located on the low-temperature side, so that the frost covering the surface of the cooling element 148 is melted and thereby removed by the heat of the high-temperature-side fluid.

The fluid cooled as a result of heat exchange moves to the high-temperature side, where the fluid collects heat and is thereby heated. The fluid is then transferred to the low-temperature side, where the fluid contributes to the defrosting of the cooling element 148 again. As the fluid is circulated through the closed circuit in this way, the frost covering the cooling element 148 is gradually removed.

As described above, in this embodiment, the cooling element 148 is defrosted by exploiting the heat radiated from the high-temperature head portion 2*b* of the cooling device 2. This eliminates the need for a separate heating means such as a heater, and thus helps reduce the running costs of defrosting. The defrosting of the cooling element 148 may be performed periodically at predetermined time intervals by the use of a timer.

Figure 12:
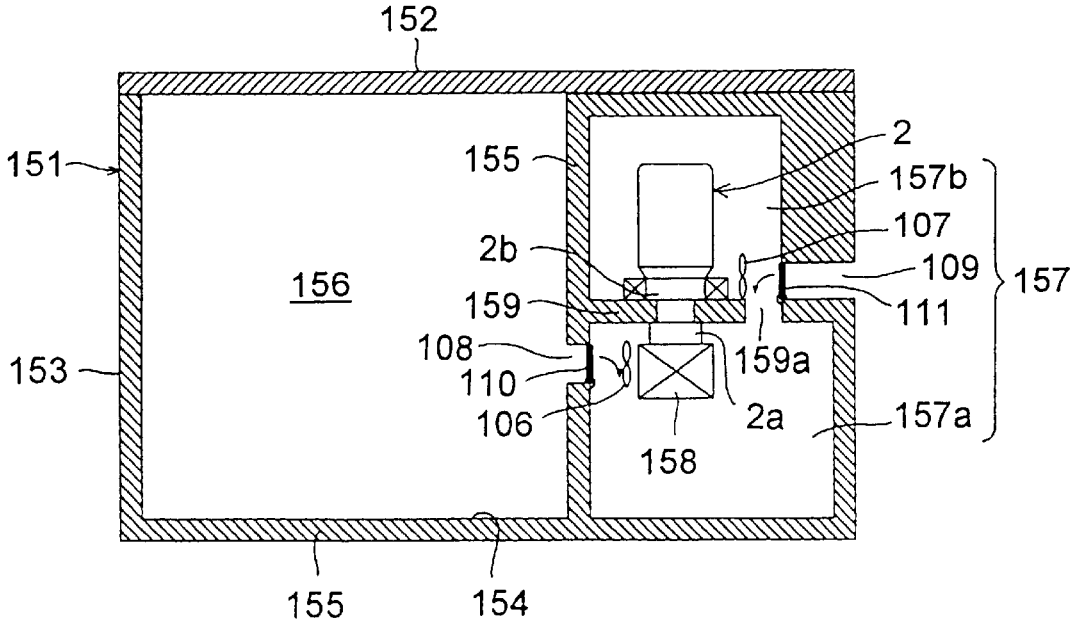
FIG. 12 is a schematic side sectional view of the cooler box of an eleventh embodiment of the invention.

Next, an eleventh embodiment of the invention will be described with reference to the drawings. FIG. 12 is a side sectional view of the cooler box of the eleventh embodiment. This cooler box is composed of a body member 151 formed in the shape of a box and a lid member 152 for opening and closing the opening formed in the top face of the body member 151. The body member 151 is composed of an outer box 153 and an inner box 154, and the gap between them is filled with a heat insulator 155. The heat insulator 155 also divides the space inside the inner box 154 into a cooling chamber 156 and a machine chamber 157.

Inside the machine chamber 157 enclosed by the heat insulator 155 from all around, a cooling device 2 is housed. The space inside the machine chamber 157 formed inside the body member 151 and enclosed by the heat insulator 155 from all around is divided by a partition wall 159 into a cooling side 157*a*, where the cooling device 2 is housed, and a heat rejecting side 157*b*, where the high-temperature head portion 2*b* of the cooling device 2 is placed.

There are also provided a first valve 110 for opening and closing an opening 108 through which the cooling side 157*a* of the machine chamber 157 and the cooling chamber 156 communicate with each other, and a second valve 111 for opening and closing one of an opening 109 through which the heat rejecting side 157*b* of the machine chamber 157 communicate with the external space or an opening 159*a* formed in the partition wall 159 separating the heat rejecting side 157*b* and the cooling side 157*a*.

In this embodiment also, as in the ninth embodiment described earlier, a temperature sensor (not shown) for detecting the surface temperature of the cooling element 158 is provided, and, when the result of detection by the temperature sensor indicates that the cooling element 158 needs to be defrosted, the operation of the cooler box is switched to a defrosting mode. Specifically, in the defrosting mode, the first valve 110 is closed, and the second valve 111 opens the opening 159*a* in the partition wall 159. Thus, by the wind produced by the second fan 107, the heat in the heat rejecting side 157*b* of the machine chamber 157 is transferred to the cooling side 157*a* of the machine chamber 157.

In this way, it is possible to transfer the heat in the heat rejecting side 157*b* to the cooling side 157*a* and thereby efficiently defrost the cooling element 158. After defrosting, the first valve 110 is opened, and the second valve 111 closes the opening 159*a* in the partition wall 159. This switches the operation of the cooler box back to the normal cooling mode. In this state, the cold from the cooling element 158 is introduced into the cooling chamber 156, and the heat in the heat rejecting side 157*b* is rejected through the opening 109 to the external space. Thus, the drink and food placed inside the cooling chamber 156 are cooled by the cold.

Next, a twelfth embodiment of the invention will be described. Under normal conditions under which the free-piston-type Stirling-cycle refrigerator shown in FIG. 1 is used, the displacer 62 slides while maintaining a predetermined phase difference relative to the piston 56. This phase difference is determined, as long as the other operating conditions are equal, the mass of the displacer 62, the spring constant of the spring 57, and the operating frequency. Of these, the mass of the displacer 62 is standardized at the time of designing, and therefore cannot be changed after the Stirling-cycle refrigerator is assembled.

Figure 13:
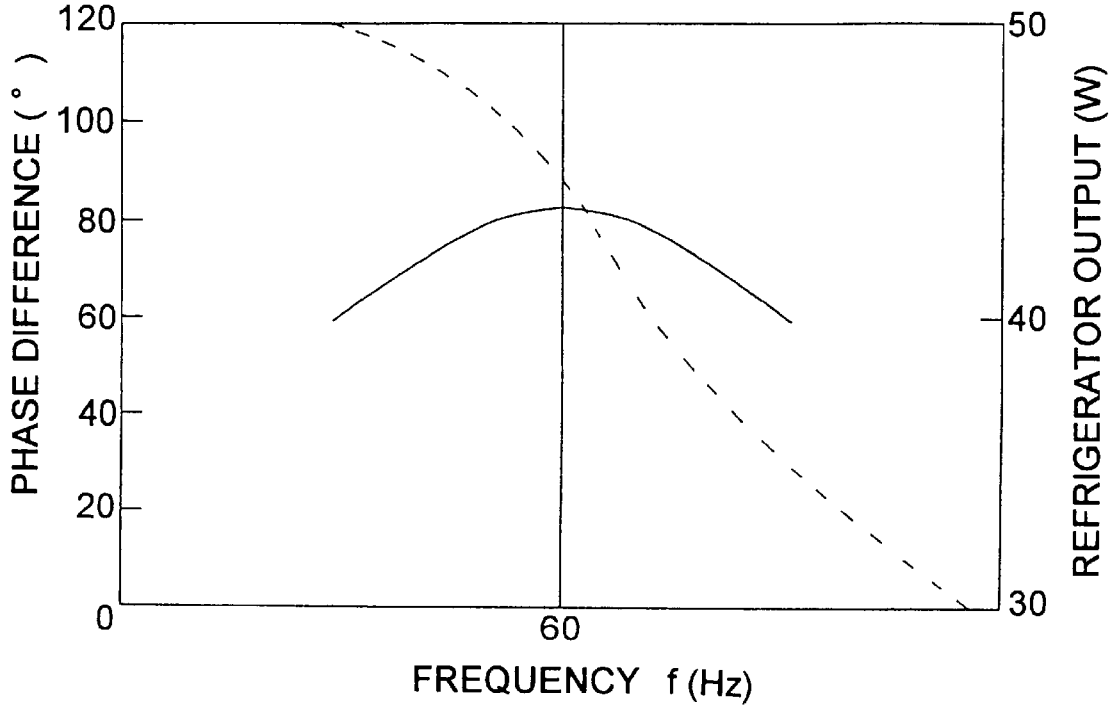
FIG. 13 is a diagram illustrating an example of the relationship between the frequency of the applied voltage, the phase difference between the piston and the displacer, and the refrigerator output of the Stirling-cycle refrigerator in the cooler box of a twelfth embodiment of the invention.

FIG. 13 shows an example of the relationship between the frequency (Hz) of the alternating-current voltage applied to the linear motor 58, which is the external power source for driving the piston 56, the phase difference (°) between the piston 56 and the displacer 62, and the refrigerator output (W) obtained from the Stirling-cycle refrigerator. In the figure, the broken line indicates the phase difference, and the solid line indicates the refrigerator output. This Stirling-cycle refrigerator is designed to yield the maximum refrigerator output when the piston 56 is driven by application of a voltage having a frequency of 60 Hz, i.e., its resonance frequency.

With this Stirling-cycle refrigerator, the following facts have been confirmed. As the frequency of the voltage for driving the piston 56 is made lower and lower below the resonance frequency, whereas the phase difference between the piston 56 and the displacer 62 becomes greater, the refrigerating performance lowers. On the other hand, as the frequency is made higher and higher above the resonance frequency, the phase difference becomes smaller and smaller, eventually becoming zero. In this state, the piston 56 and the displacer 62 slide in phase, and thus, while the volume of the expansion space 59 remains constant, the expansion and compression of the working gas are repeated only in the expansion space 60.

In this embodiment, when the cooling element (not shown) is recognized to need defrosting, the frequency of the applied voltage is so controlled that the piston 56 and the displacer 62 operate with completely or substantially no phase difference as described above. As a result, as opposed to the ordinary reverse Stirling cycle, the compression taking place in the expansion space 60 generates heat, and thus raises the temperature of the heat absorbing portion 64.

This raises the temperature of the cooling element (not shown) disposed next to the heat absorbing portion 64, gradually melting and removing the frost covering the cooling element. Thus, it is possible to remove frost covering the surface of the cooling element simply by controlling the frequency of the voltage applied to the linear motor 58, without separately providing a heating means for heating the cooling element or a heat transferring means for transferring the heat radiated from the heat rejecting portion. This makes it possible to realize, at low costs, a cooler box that allows the Stirling-cycle refrigerator to offer stable refrigerating performance continuously.

Hereinafter, energy-saving cooler boxes will be described that cool or keep cool drink, food, or the like placed inside it while keeping their freshness by storing cold obtained from a cooling device.

Figure 14:
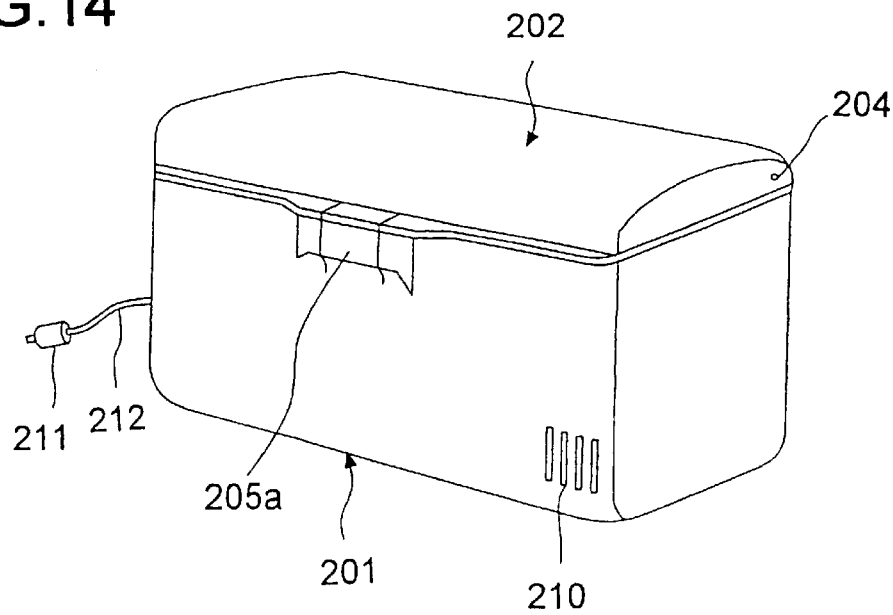
FIG. 14 is an external perspective view of the cooler box of a thirteenth embodiment of the invention.

Now, a thirteenth embodiment of the invention will be described with reference to the drawings. FIG. 14 is an external perspective view of the cooler box of this embodiment. This cooler box is composed of a body member 201 and a lid member 202, and is formed substantially in the shape of a rectangular parallelepiped as a whole. In a right-hand portion of the front face of the body member 201, slits 210 are formed as openings. The cooler box is connected to an external power source with a power plug 211 by way of a cord 212 connecting the body member 201 to the power plug 211.

Figure 15:
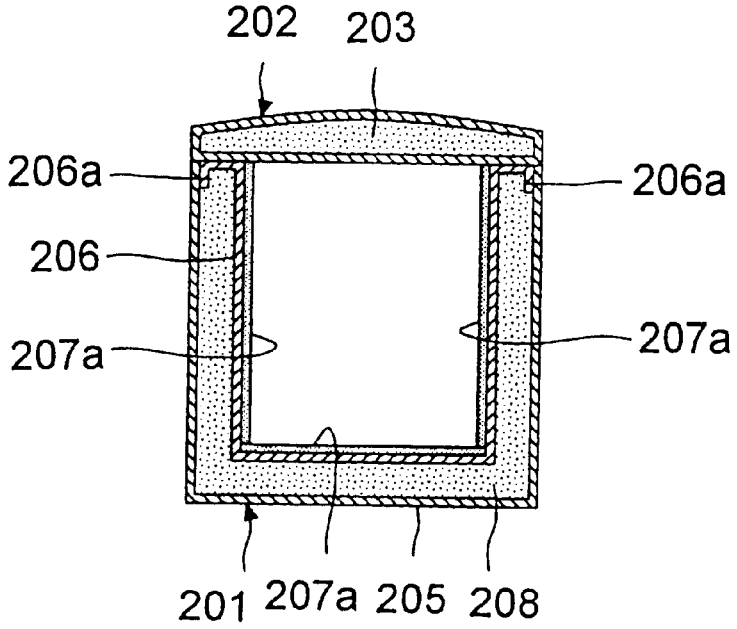
FIG. 15 is a vertical sectional view showing a case where the cold storing member is laid on the bottom and side surfaces.

FIG. 15 is a side sectional view of the cooler box. As shown in FIG. 15, the lid member 202 has its interior filled with an heat insulator 203, and is fitted to the body member 201 so as to be pivotable relative to it about a hinge pin 204 (FIG. 14). An outer casing 205 is made of synthetic resin, and has the shape of a box with a substantially rectangular bottom wall and an open top. On the outside of the outer casing 205, a hook 205*a* (FIG. 14) is formed to which to secure the lid member 202. An inner casing 206 is made of synthetic resin, and has the shape of a box with a substantially rectangular bottom wall and an open top. Around the rim of the top end of the inner casing 206, a flange 206*a* is formed to which to secure the top end of the outer casing 205.

Figure 16:
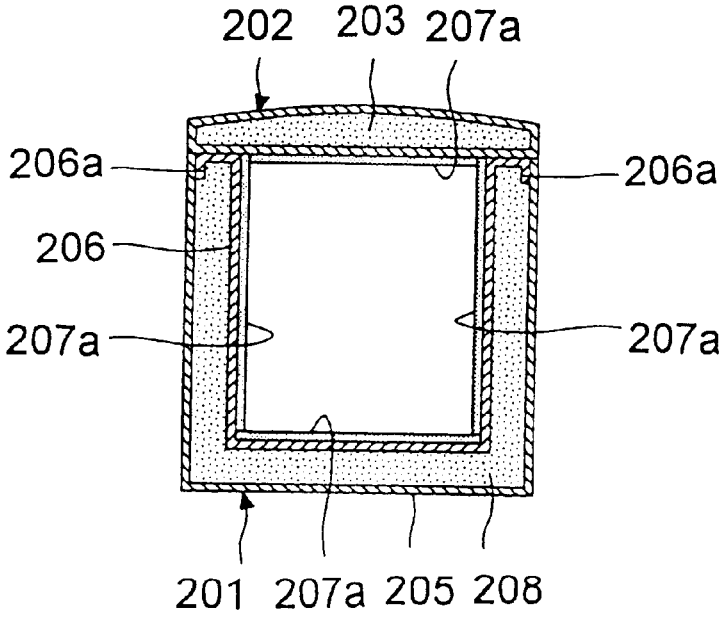
FIG. 16 is a vertical sectional view showing a case where the cold storing member is laid on all the surfaces.

A sheet-shaped cold storing member 207*a* formed out of a metal having a high heat storing capability, such as stainless steel, aluminum, copper, or the like, is laid on the bottom and side surfaces of the inner casing 206 so as to be kept in intimate contact with those surfaces with no gap left in between. This cold storing member 207*a* may be laid on only part of the bottom and side surfaces of the inner casing 206. As shown in FIG. 16, a similar cold storing member 207*a* may be laid on the undersurface of the lid member 202. The temperature inside the inner casing 206 is maintained by a heat insulator 208 that fills the gap between the outer casing 205 and the inner casing 206.

Figure 17:
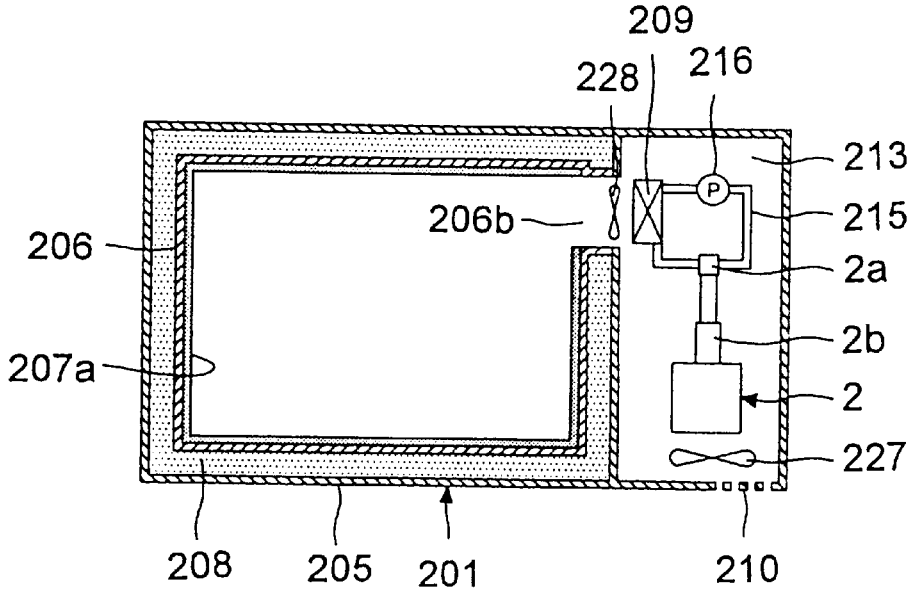
FIG. 17 is a horizontal sectional view of the cooler box.

FIG. 17 is a horizontal sectional view of the cooler box. On the right side of the body member 201, a machine chamber 213 is formed. Inside this machine chamber 213, a cooling device 2 is housed in a horizontal position. A cooling element 209 having a large number of fins formed inside it is disposed so as to face an opening 206*b* that is formed in part of the inner casing 206 so as to communicate with the machine chamber 213. Between the cooling element 209 and the low-temperature head portion 2*a* of the cooling device 2, a cooling medium conduit 215 is provided through which a cooling medium is circulated by a pump 216. The heat generated inside the machine chamber 213 is rejected out of the body member 201 through the slits 210 by a cooling fan 227. The cold transferred to the cooling element 209 is blown into the inner casing 206 through the opening 206*b* by a blower fan 228.

Next, an example of the operation of the cooler box constructed as described above will be described with reference to FIGS. 14 to 17. An article to be cooled, such as drink or food, is placed inside the inner casing 206, and the power plug 211 is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a,* where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part of the cold is stored in the cold storing member 207*a* laid on the bottom and side surfaces of the inner casing 206. Thus, the cold blown into the inner casing 206, working together with the cold radiating from the cold stored in the cold storing member 207*a,* ensures continuous and stable cooling performance for a to-be-cooled article in which freshness matters. Moreover, even when the cooling device 2 stops being operated, the cold stored in the cold storing member 207*a* maintains the low temperature inside the inner casing 206. This helps greatly reduce the time required for the interior temperature of the cooler box to reach the set temperature when it is operated next time.

Figure 18:
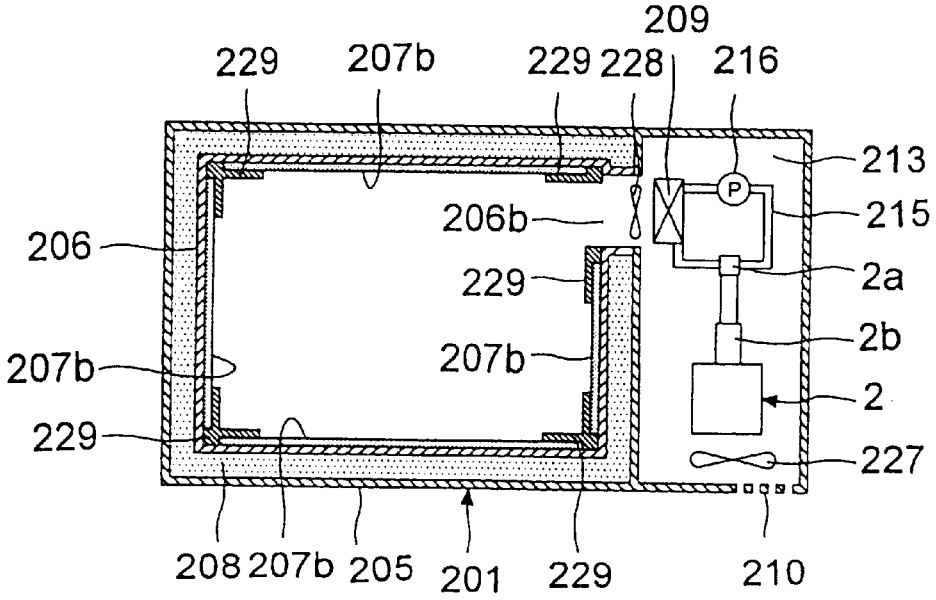
FIG. 18 is a horizontal sectional view of a fourteenth embodiment of the invention.

Next, a fourteenth embodiment of the invention will be described with reference to the drawings. FIG. 18 is a horizontal sectional view of the cooler box of this embodiment. In FIG. 18, such members as are common to this embodiment and the thirteenth embodiment described above are identified with the same reference numerals, and their detailed explanations will be omitted.

Figure 19:
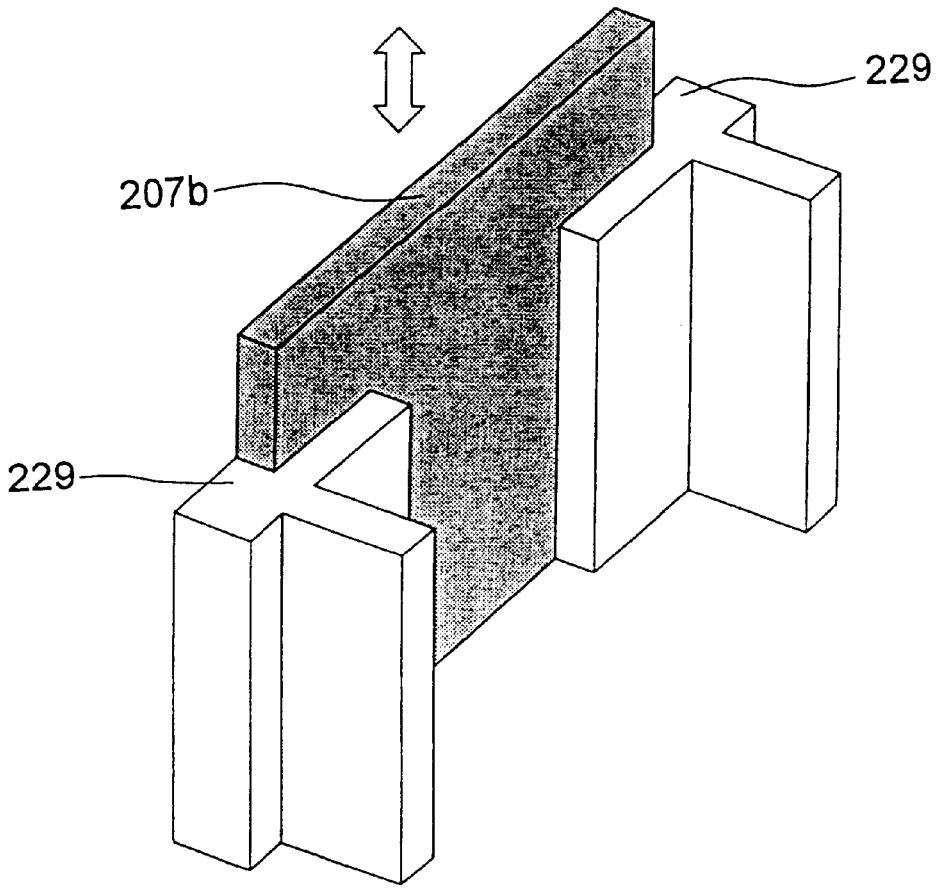
FIG. 19 is a perspective view of a principal portion of the cooler box.

The features characteristic of this embodiment are as follows. As shown in FIG. 18, in the corners inside the inner casing 206, support members 229 are provided so as to form gaps substantially parallel to the side surfaces of the inner casing 206. Then, as shown in FIG. 19, sheet-shaped cold storing members 207*b* formed out of a material having high heat conductivity, such as aluminum or copper, are fitted into the gaps between the support members 229 and the inner casing 206 by being slid from above.

Next, an example of the operation of the cooler box constructed as described above will be described with reference to FIG. 18. An article to be cooled, such as drink or food, is placed inside the inner casing 206, and the power plug 211 (FIG. 14) is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a,* where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part of the cold is stored in the cold storing members 207*b* placed along the side surfaces of the inner casing 206. Thus, the cold blown into the inner casing 206, working together with the cold radiating from the cold stored in the cold storing members 207*b,* ensures continuous and stable cooling performance for a to-be-cooled article in which freshness matters. Moreover, even when the cooling device 2 stops being operated, the cold stored in the cold storing members 207*b* maintains the low temperature inside the inner casing 206. This helps greatly reduce the time required for the interior temperature of the cooler box to reach the set temperature when it is operated next time.

Moreover, in this embodiment, the cold storing members 207*b* are detachable from the inner casing 206, and thus can be removed for cleaning as required. This helps keep the interior of the inner casing 206 hygienic.

Figure 20A:
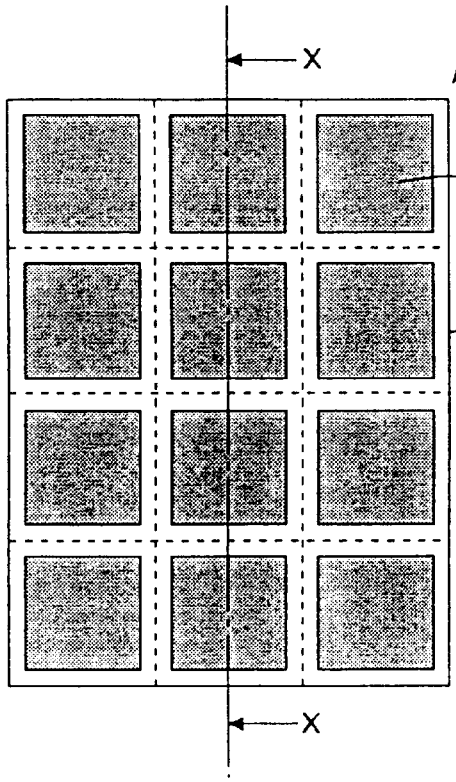
FIGS. 20A and 20B are diagrams showing the composite cold storing member used in the cooler box of a fifteenth embodiment of the invention.
Figure 20B:
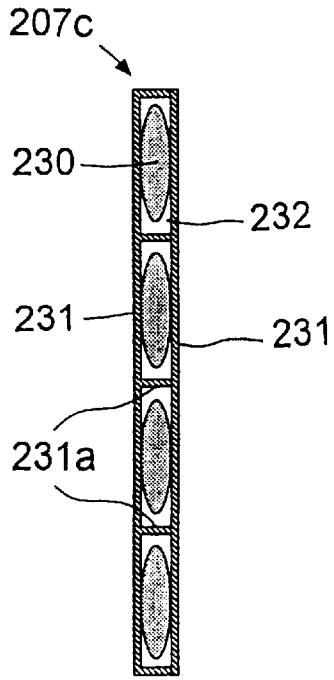

Next, a fifteenth embodiment of the invention will be described with reference to the drawings. FIGS. 20A and 20B are diagrams showing the composite cold storing member used in the cooler box of this embodiment. FIG. 20A is a front view, and FIG. 20B is a sectional view along line x—x shown in FIG. 20A. As shown in FIGS. 20A and 20B, the composite cold storing member 207*c* is composed of two cold storing plates 231 and 231 put together, each having ribs 231*a* formed in the shape of a lattice so as to protrude from the back surface thereof, with a plurality of cold storing members 230, 230, . . . placed individually in the plurality of spaces 232, 232, 232, . . . partitioned off by the ribs 231*a*. A plurality of the composite cold storing member so produced are laid, as in the thirteenth embodiment described earlier, on the bottom and side surfaces of the inner casing 206 (FIG. 17).

Here, both the cold storing members 230 and the cold storing plates 231 have a cold storing effect, and in addition the cold storing plates 231 prevent an abrupt rise in temperature of the cold storing members 230. This enhances the cold storing efficiency per unit area of the composite cold storing members 207*c*. Thus, the cold blown into the inner casing 206 (FIG. 17), working together with the cold radiating from the cold stored in the composite cold storing members 207*c,* ensures continuous and stable cooling performance for a to-be-cooled article in which freshness matters. Moreover, even when the cooling device 2 stops being operated, the cold stored in the composite cold storing members 207*a* maintains the low temperature inside the inner casing 206. This helps greatly reduce the time required for the interior temperature of the cooler box to reach the set temperature when it is operated next time.

The above description of this embodiment deals with a case where the composite cold storing members 207*c* are fixed to the side surfaces of the inner casing 206 so as to be kept in intimate contact with them. It is, however, also possible to make the composite cold storing members 207*c* detachable as in the fourteenth embodiment described earlier. In that case, the composite cold storing members 207*c* can be removed for cleaning as required. This helps keep the interior of the inner casing 206 hygienic.

Figure 21:
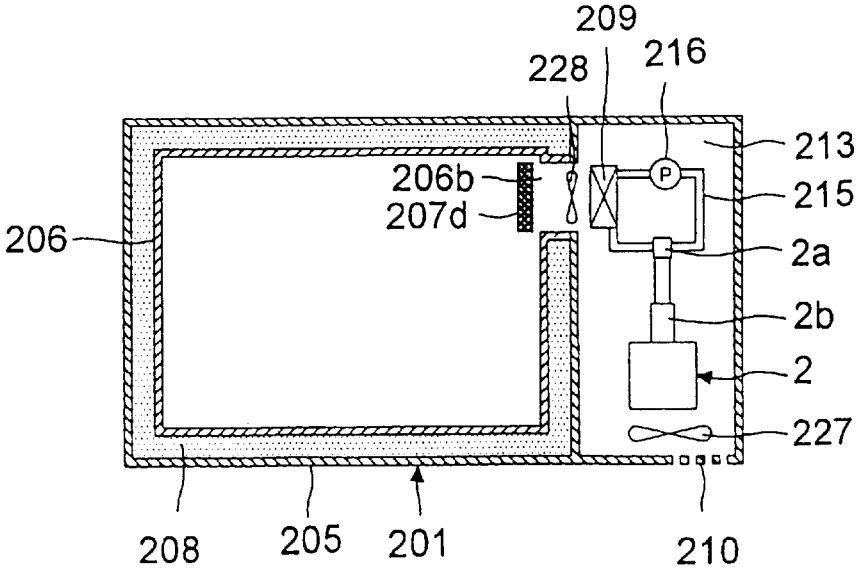
FIG. 21 is a horizontal sectional view of the cooler box of a sixteenth embodiment of the invention.

Next, a sixteenth embodiment of the invention will be described with reference to the drawings. FIG. 21 is a horizontal sectional view of the cooler box of this embodiment. In FIG. 21, such members as are common to this embodiment and the thirteenth embodiment described earlier are identified with the same reference numerals, and their detailed explanations will be omitted.

The feature characteristic of this embodiment is as follows. As shown in FIG. 21, near the opening 206*b* of the inner casing 206, a granular cold storing material 207*d* is placed. The cold storing material 207*d* is prepared as fine granules of a metal contained in a breathable box or the like.

Next, an example of the operation of the cooler box constructed as described above will be described with reference to FIG. 21. An article to be cooled, such as drink or food, is placed inside the inner casing 206, and the power plug 211 (FIG. 14) is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a,* where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part of the cold is stored in the cold storing material 207*d* placed near the opening 206*b* of the inner casing 206. Thus, the cold blown into the inner casing 206, working together with the cold radiating from the cold stored in the cold storing material 207*d,* ensures continuous and stable cooling performance for a to-be-cooled article in which freshness matters.

Moreover, even when the cooling device 2 stops being operated, the cold stored in the cold storing material 207*d* maintains the low temperature inside the inner casing 206. This helps greatly reduce the time required for the interior temperature of the cooler box to reach the set temperature when it is operated next time. Furthermore, in this embodiment, the breathable, granular cold storing material 207*d* prepared in a compact form is placed inside the inner casing 206. This permits the cooled air to strike the granular cold storing material 207*d* so as to achieve efficient storage of the cold, and helps leave an ample space inside the inner casing 206 for the placement of articles to be cooled.

Figure 22:
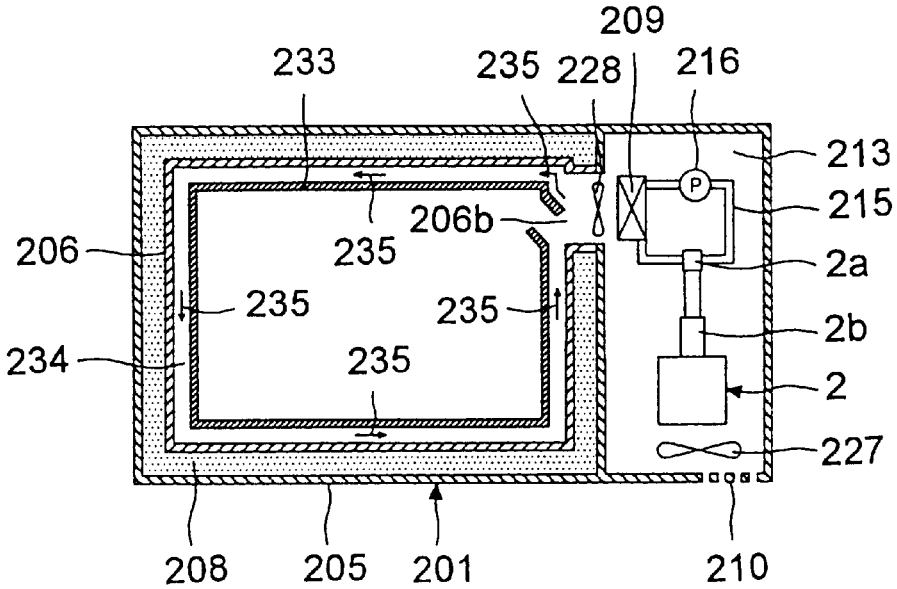
FIG. 22 is a horizontal sectional view of the cooler box of a seventeenth embodiment of the invention.

Next, a seventeenth embodiment of the invention will be described with reference to the drawings. FIG. 22 is a horizontal sectional view of the cooler box of this embodiment. In FIG. 22, such members as are common to this embodiment and the thirteenth embodiment described earlier are identified with the same reference numerals, and their detailed explanations will be omitted.

The features characteristic of this embodiment are as follows. As shown in FIG. 22, along the side surfaces of the inner casing 206, a partition wall 233 is provided with a predetermined gap left from the inner casing 206. In this way, a cold circulation path 234 is formed all around the side surfaces of the inner casing 206 so as to extend from the bottom surface to the top face thereof.

Next, an example of the operation of the cooler box constructed as described above will be described with reference to FIG. 22. An article to be cooled, such as drink or food, is placed inside the inner casing 206, and the power plug 211 (FIG. 14) is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a,* where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part 235 of the cold flows into the cold circulation path 234, and is circulated through it by the wind produced by the blower fan 228. This circulation of the cold 235 keeps the interior of the cold circulation path 234 cold all the time, producing a cold storing effect. Thus, the cold blown into the inner casing 206, working together with the cold radiating through the partition wall 233 from the cold stored inside the cold circulation path 234, ensures continuous and stable cooling performance for a to-be-cooled article in which freshness matters.

Moreover, even when the cooling device 2 stops being operated, the cold stored inside the cold circulation path 234 maintains the low temperature inside the inner casing 206. This helps greatly reduce the time required for the interior temperature of the cooler box to reach the set temperature when it is operated next time.

Figure 23:
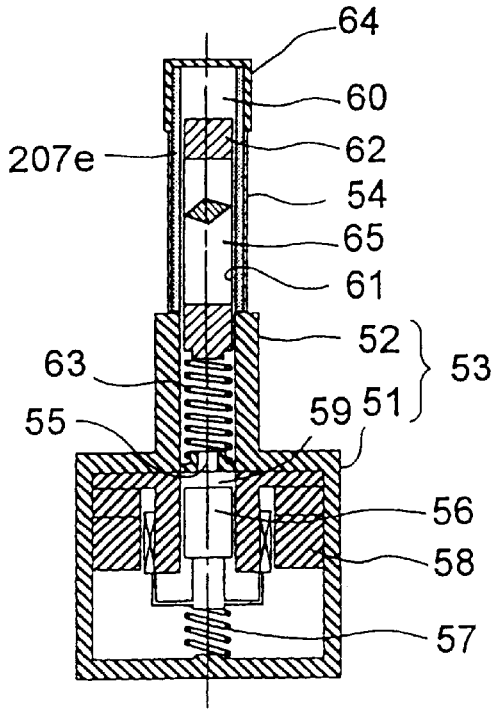
FIG. 23 is a sectional view of the free-piston-type Stirling-cycle refrigerator used in the cooler box of an eighteenth embodiment of the invention.

Next, an eighteenth embodiment of the invention will be described with reference to the drawings. FIG. 23 is a sectional view of the free-piston-type Stirling-cycle refrigerator used in the cooler box of this embodiment. As shown in FIG. 23, the feature characteristic of this embodiment is that a cylindrical cold storing member 207*e* is provided inside the cylinder of the Stirling-cycle refrigerator, in the low-temperature-side portion thereof including the expansion space 60.

In this construction, when the cooling device 2 starts being operated, the cold generated in the expansion space 60 is stored in the cold storing member 207*e* so as to maintain the low temperature of the cylinder including the expansion space 60. Thus, even when the cooling device 2 stops being operated, it is possible to greatly reduce the time required for the interior temperature of the cooler box to reach the set temperature. This helps reduce electric power consumption, and thus helps realize a power-saving cooler box.

Figure 24:
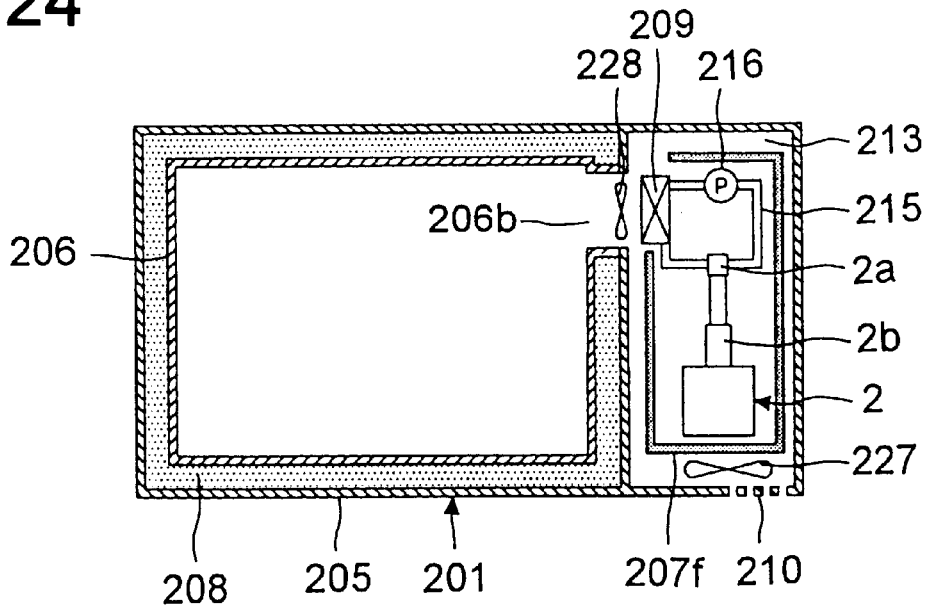
FIG. 24 is a horizontal sectional view of the cooler box of a nineteenth embodiment of the invention.

Next, a nineteenth embodiment of the invention will be described with reference to the drawings. FIG. 24 is a horizontal sectional view of the cooler box of this embodiment. In FIG. 24, such members as are common to this embodiment and the thirteenth embodiment described earlier are identified with the same reference numerals, and their detailed explanations will be omitted.

The feature characteristic of this embodiment is as follows. As shown in FIG. 24, inside the machine chamber 213, a cold storing member 207*f* is provided so as to enclose the entire cold generating means including the cooling device 2, the cooling element 209, and the cooling medium conduit 215.

Next, an example of the operation of the cooler box constructed as described above will be described with reference to FIG. 24. An article to be cooled, such as drink or food, is placed inside the inner casing 206, and the power plug 211 (FIG. 14) is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a,* where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part of the cold is radiated from the cooling medium conduit 215, which is involved in the transfer of the cold generated in the low-temperature head portion 2*a* to the cooling element 209, and the cold storing member 207*f* provided so as to enclose the cooling device 2 and other members receives and stores that part of the cold. Thus, the cold blown into the inner casing 206, working together with the cold radiating from the cold stored in the cold storing member 207*f,* ensures continuous and stable cooling performance for a to-be-cooled article in which freshness matters.

Moreover, even when the cooling device 2 stops being operated, the cold stored in the cold storing member 207*f* maintains the low temperature around the cooling device 2. This helps greatly reduce the time required for the interior temperature of the cooler box to reach the set temperature when it is operated next time. This helps reduce electric power consumption, and thus helps realize a power-saving cooler box.

Figure 25:
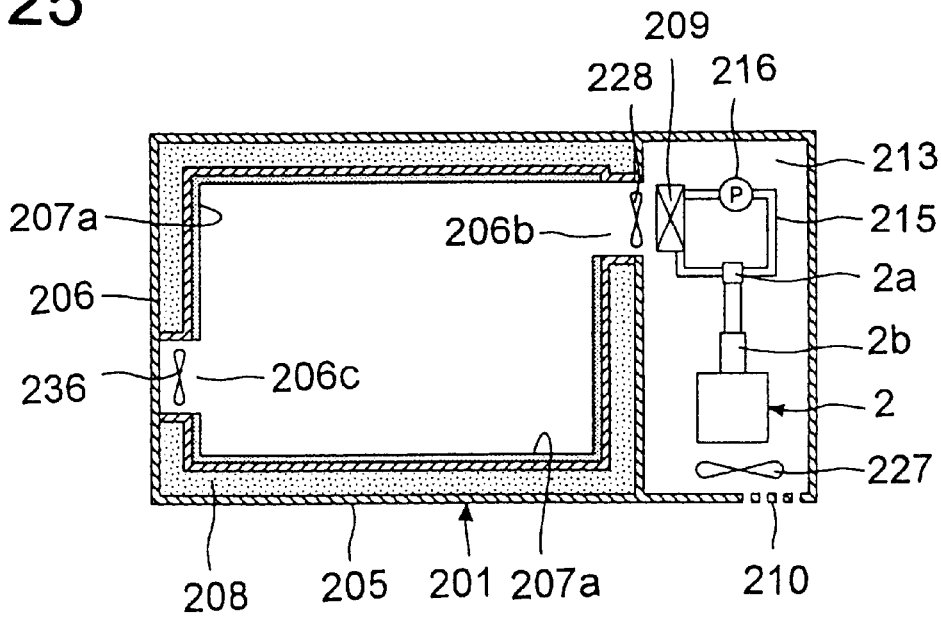
FIG. 25 is a horizontal sectional view of the cooler box of a twentieth embodiment of the invention.

Next, a twentieth embodiment of the invention will be described with reference to the drawings. FIG. 25 is a horizontal sectional view of the cooler box of this embodiment. In FIG. 25, such members as are common to this embodiment and the thirteenth embodiment described earlier are identified with the same reference numerals, and their detailed explanations will be omitted.

The features characteristic of this embodiment are as follows. As shown in FIG. 25, in part of the inner casing 206, an opening 206*c* is formed so as to penetrate the heat insulator 208. Inside this opening 206*c*, a circulating fan 236 for circulating the cold inside the inner casing 206 is provided so as to face the inner casing 206.

Next, an example of the operation of the cooler box constructed as described above will be described with reference to FIG. 25. An article to be cooled, such as drink or food, is placed inside the inner casing 206, and the power plug 211 is plugged into an outlet of commercially distributed electric power. When the power is turned on, the cooling device 2 starts being operated. In the reverse Stirling cycle, the cold generated in the low-temperature head 2*a* is transferred to the cooling element 209 by the cooling medium circulated through the cooling medium conduit 215 by the pump 216 operating together, and is thus delivered to the cooling element 209. The cooling medium, after yielding the cold to the cooling element 209 and thus becoming less cool, flows through the cooling medium conduit 215 back to the low-temperature head portion 2*a*, where the cooling medium collects cold. As the cooling medium is continuously circulated in this way, the cooling element 209 is cooled gradually to a cryogenic temperature.

The cold delivered to the cooling element 209 is blown into the inner casing 206 by the wind produced by the blower fan 228 so that the to-be-cooled article is kept cool by being cooled or frozen. Here, part of the cold is stored in the cold storing member 207*a* laid on the bottom and side surfaces of the inner casing 206. Simultaneously, the circulating fan 236 is driven so that the cold inside the inner casing 206 is agitated by the wind produced by it.

Thus, the cold blown into the inner casing 206, working together with the cold radiating from the cold stored in the cold storing member 207*a*, ensures continuous and stable cooling performance for a to-be-cooled article in which freshness matters. Here, the circulating fan 236 makes the temperature distribution inside the inner casing 206 uniform, and thus prevents the to-be-cooled article from being cooled differently depending on where it is placed inside the inner casing 206. This enhances the reliability of the refrigerating performance of the cooler box. Moreover, even when the cooling device 2 stops being operated, the cold stored in the cold storing member 207*a* maintains the low temperature inside the inner casing 206. This helps greatly reduce the time required for the interior temperature of the cooler box to reach the set temperature when it is operated next time.

The above description of this embodiment takes up, as an example, the thirteenth embodiment, where the cold storing member 207*a* is fixed to the side surfaces of the inner casing 206, to explain the additional mechanism involving the circulation of the cold inside the inner casing 206 by the circulating fan 236. However, this mechanism may be added to any other embodiment, i.e., any of the fourteenth to twelfth embodiments described earlier.

Figure 26:
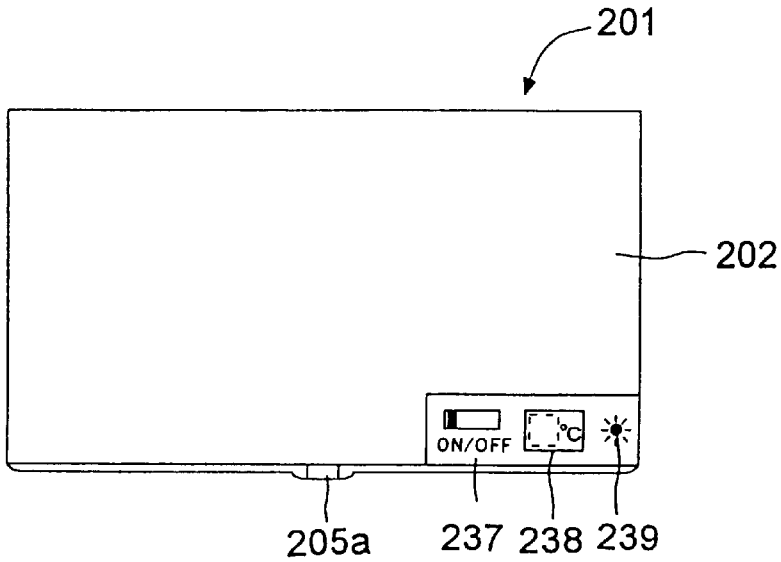
FIG. 26 is a top view of the cooler box of a twenty-first embodiment of the invention.
Figure 27:
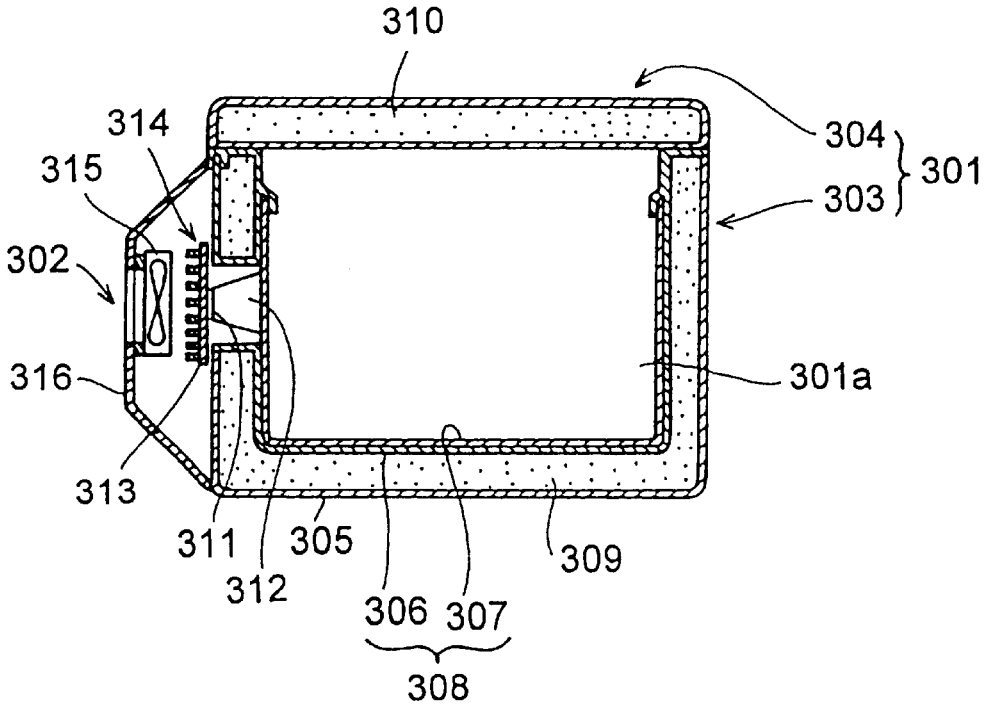
FIG. 27 is a vertical sectional view of a conventional cooler box.

Next, a twenty-first embodiment of the invention will be described with reference to the drawings. FIG. 26 is a top view of the cooler box of this embodiment. The features characteristic of this embodiment are as follows. As shown in FIG. 26, in part of the top surface of the lid member 202, there are provided a switch 237 for turning on and off the cold storage mode, a temperature controller 238 that permits adjustment of the temperature inside the inner casing 206 (FIG. 17), and an LED lamp 239 for indicating that the cold storage mode is in operation.

In this construction, whether to store cold as described above or not can be chosen by operating the switch 237. Thus, for example, when the cooler box is used while carried around outdoors, by turning the switch 237 on, it is possible to previously cool the interior of the inner casing 206 so as to make the cooler box ready for use whenever necessary. This makes it possible to keep to-be-cooled articles, such as fish and shellfish caught at see, cool and fresh until the user gets home. Moreover, when the cold storage mode is on, the LED lamp 239 is lit to indicate, to other people than the user, that the cold storage mode is on. This permits easy confirmation of the operation status of the cooler box.

Moreover, the temperature controller 238 permits the set temperature to be varied freely according to use. For example, if the set temperature is allowed to be varied freely in the range of from 5° C. to −30° C., the user can take home fish and shellfish caught at see while keeping them at a cryogenic temperature below the freezing point, or take home food bought while keeping it at about 5° C. in a car without bothering about the rise in the temperature inside the car even in summer. Thus, it is possible to realize a user-friendly cooler box that can cope with various purposes.

Obviously, many modifications and variations of the present invention are possible in light of the above teachings. It is therefore to be understood that within the scope of the appended claims, the invention may be practiced other than as specifically described.

INDUSTRIAL APPLICABILITY

As described above, according to the present invention, by using a Stirling-cycle refrigerator as a cooling device, it is possible to realize a cooler box that can be operated from an easily available low-capacity, inexpensive power supply and that can cool a to-be-cooled article to a low temperature comparable with that produced by a freezer.

By fitting the cooling device to a detachable lid member, it is possible to detach the lid member and wash it in its entirety, ensuring easy cleaning.

By fitting the cooling device to the bottom wall of the box member, it is possible to reduce the thickness of the side walls of the box member and thus the floor area occupied.

By fitting the cooling device to the box member with its low-temperature head located below its high-temperature head, it is possible to prevent the air heated by the high-temperature head from making contact with the low-temperature head, and thereby minimize the loss of cooling efficiency.

By providing, as the cooling device, a plurality of cooling devices that can be driven independently of one another, it is possible to cope with various set temperatures and various cooling patterns, and to obtain more uniform temperature.

By using a box member having one or two pair of opposite side walls and fitting the cooling device to each of the opposite side walls constituting each pair, it is possible to obtain more uniform temperature.

By making the cooling device detachable, it is possible to attach a cooling device most suitable to cool a given article and thereby achieve efficient cooling.

By providing a liquid nitrogen container for instantaneously freezing a to-be-cooled article placed inside the cooling chamber, it is possible to cope with an article that needs to be cooled or frozen instantaneously.

By making the volume of the cooling chamber variable, it is possible to adjust the volume of the cooling chamber according to a to-be-cooled article so as to achieve efficient cooling.

By providing a cooling element at the low-temperature head of the cooling device and air circulating means for circulating the air inside the cooling chamber so as to bring the air into contact with the cooling element, it is possible to obtain more uniform temperature inside the cooling chamber.

By using a cooling element having a heat pipe, it is possible to conduct the low temperature produced by the Stirling-cycle refrigerator efficiently to the cooling element, and thereby cool the air inside the cooling chamber efficiently.

By using a Stirling-cycle refrigerator of a free-piston type that has a displacer reciprocating inside a cylinder filled with a working gas, it is possible to achieve miniaturization and weight reduction.

In a cooler box that uses a Stirling-cycle refrigerator as a source of cold, by providing means for removing frost, even when frost forms on the cooling element that receives cryogenic cold and contributes to the cooling of the interior of the cooling chamber, it is possible to realize a cooler box that allows the Stirling-cycle refrigerator to offer stable refrigerating performance continuously.

Here, examples of the means for removing frost include heating means such as a heater, means for transferring the heat radiated from the heat rejecting portion to the cooling element by the use of a fluid, or means for transferring the heat radiated from the heat rejecting portion of the Stirling-cycle refrigerator to the cooling element by the use of valves. Any of these offers a simple construction that achieves the removal of frost without fail.

Alternatively, by controlling the Stirling-cycle refrigerator with phase difference controlling means in such a way that the displacer and the piston sliding inside its cylinder operate with completely or substantially no phase difference, it is also possible to defrost the cooling element with the heat generated in the expansion space. In that case, there is no need to provide defrosting means separately from the Stirling-cycle refrigerator, and thus it is possible to realize, at low costs, a cooler box the allows the Stirling-cycle refrigerator to offer stable refrigerating performance continuously.

In a cooler box that includes a heat insulating box member having the interior thereof divided into a machine chamber and a cooling chamber and that cools food or drink placed inside the cooling chamber by introducing cold, produced by driving a Stirling-cycle refrigerator disposed inside the machine chamber, into the cooling chamber, by providing, inside the cooling chamber or the machine chamber, cold storing means for storing the cold, it is possible to maintain the low temperature inside the cooling chamber. The cold blown into the cooling chamber, working together with the cold radiated from the cold storing means, ensures continuous and stable refrigerating performance. Even when the Stirling-cycle refrigerator stops being operated, it is possible to maintain the low temperature inside the cooling chamber with the stored cold. This helps greatly reduce the time required for the interior temperature of the cooler box to reach the set temperature when it is operated next time, and thus helps save energy accordingly.

What is claimed is:

1. A cooler box including a heat insulating box member having an interior thereof divided into a machine chamber and a cooling chamber, the cooler box cooling food or drink placed inside the cooling chamber by introducing cold, produced by driving a Stirling-cycle refrigerator disposed inside the machine chamber, into the cooling chamber through a cooling element, wherein the Stirling-cycle refrigerator is of a free-piston type that has a displacer reciprocating inside a cylinder filled with a working gas, and the cooler box further comprises:

means for removing frost covering the cooling element, the means for removing frost being waste heat conducting means for conducting heat radiated from a heat rejecting portion of the Stirling-cycle refrigerator to the cooling element, the waste heat conducting means comprising:

a first conduit for circulating a fluid between the heat rejecting portion of the Stirling-cycle refrigerator and a heat exchanger disposed away from the heat rejecting portion;

a second conduit for circulating the fluid between a heat absorbing portion of the Stirling-cycle refrigerator and the cooling element disposed away from the heat absorbing portion; and flow path switching means located at where the first and second conduits cross each other to permit the first and second conduits to communicate with each other so as to form a single closed circuit.

2. A cooler box including a heat insulating box member having an interior thereof divided into a machine chamber and a cooling chamber, the cooler box cooling food or drink placed inside the cooling chamber by introducing cold, produced by driving a Stirling-cycle refrigerator disposed inside the machine chamber, into the cooling chamber through a cooling element, wherein the Stirling-cycle refrigerator is of a free-piston type that has a displacer reciprocating inside a cylinder filled with a working gas, and the cooler box further comprises:

means for removing frost covering the cooling element, and the machine chamber has an interior thereof divided by a partition wall into a cooling side where the cooling element is disposed and a heat rejecting side where the heat rejecting portion of the Stirling-cycle refrigerator is disposed, the frost removing means comprising:

a first valve for opening and closing an opening through which the cooling side of the machine chamber and the cooling chamber communicate with each other; and a second valve for opening and closing one of an opening formed in part of the partition wall or an opening formed between the heat rejecting side of the machine chamber and an interior space.

3. A cooler box including a heat insulating box member having an interior thereof divided into a machine chamber and a cooling chamber, the cooler box cooling food or drink placed inside the cooling chamber by introducing cold, produced by driving a Stirling-cycle refrigerator disposed inside the machine chamber, into the cooling chamber, wherein the Stirling-cycle refrigerator is of a free-piston type that has a displacer reciprocating inside a cylinder filled with a working gas, and the cooler box further comprises:

cold storing means for storing the cold disposed inside the cooling chamber, the cold storing means being a sheet-shaped cold storing member laid along part or all of bottom and side surfaces of the cooling chamber, the cold storing member detachably laid in the cooler box, so that it can be readily removed.

* * * * *